US009330671B2

(12) United States Patent
Norvell et al.

(10) Patent No.: US 9,330,671 B2
(45) Date of Patent: May 3, 2016

(54) ENERGY CONSERVATIVE MULTI-CHANNEL AUDIO CODING

(75) Inventors: Erik Norvell, Stockholm (SE); Martin Sehlstedt, Lulea (SE); Anisse Taleb, Kista (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 707 days.

(21) Appl. No.: 13/122,880

(22) PCT Filed: Sep. 25, 2009

(86) PCT No.: PCT/SE2009/051071

§ 371 (c)(1),
(2), (4) Date: Apr. 6, 2011

(87) PCT Pub. No.: WO2010/042024

PCT Pub. Date: Apr. 15, 2010

(65) Prior Publication Data

US 2011/0224994 A1 Sep. 15, 2011

Related U.S. Application Data

(60) Provisional application No. 61/104,404, filed on Oct. 10, 2008.

(51) Int. Cl.
*G10L 19/008* (2013.01)

(52) U.S. Cl.
CPC ..... *G10L 19/008* (2013.01)

(58) Field of Classification Search
CPC ..... G10L 19/008
See application file for complete search history.

(56) References Cited

U.S. PATENT DOCUMENTS 5,285,498 A 2/1994 Johnston
5,434,948 A 7/1995 Holt et al.

(Continued)

FOREIGN PATENT DOCUMENTS

EP 0497413 B1 4/1996
JP 11125729 A 5/1999

(Continued)

OTHER PUBLICATIONS

Phillips, et al., "Performance and functionality of existing MPEG-4 technology in the context of Cfl on Scalable Speech and Audio Coding", Jan. 1, 2005, pp. 1-16, ISO/IEC JTC 1/SC 29/WG 11/M11657, International Organization for Standardization, Hong Kong, CN.

(Continued)

*Primary Examiner* — Matthew Baker
(74) *Attorney, Agent, or Firm* — Coats & Bennett, PLLC

(57) ABSTRACT

The invention relates to the technical field of audio encoding and/or decoding technologies, and thus concerns an overall encoding procedure and associated decoding procedure. The encoding procedure involves at least two signal encoding processes (S1-S3) operating on signal representations of a set of audio input channels, as well as residual encoding (S7-S8). It also involves a dedicated process (S4-S6) to estimate and encode energies of the audio input channels. Each encoding process is associated with a corresponding decoding process. In the overall decoding procedure the decoded signals from each encoding process are preferably combined such that the output channels are close to the input channels in terms of energy and/or quality. Normally, the combination step also adapts to the possible loss of one or more signal representation in part or in whole, such that the energy and quality is optimized with the signals at hand in the decoder. In this way, the overall quality of the output channels is improved.

21 Claims, 23 Drawing Sheets

(56) References Cited

U.S. PATENT DOCUMENTS

| | | | | |
|---|---|---|---|---|
| 6,629,078 | B1 | 9/2003 | Grill et al. | |
| 7,437,299 | B2 | 10/2008 | Aarts et al. | |
| 7,447,317 | B2 * | 11/2008 | Herre et al. | 381/23 |
| 7,573,912 | B2 * | 8/2009 | Lindblom | 370/487 |
| 7,751,572 | B2 * | 7/2010 | Villemoes et al. | 381/23 |
| 7,945,447 | B2 | 5/2011 | Yoshida et al. | |
| 8,081,763 | B2 * | 12/2011 | Henn et al. | 381/22 |
| 8,116,460 | B2 * | 2/2012 | Henn et al. | 381/23 |
| 8,218,775 | B2 * | 7/2012 | Norvell et al. | 381/23 |
| 8,254,585 | B2 * | 8/2012 | Schuijers et al. | 381/23 |
| 8,447,620 | B2 * | 5/2013 | Neuendorf et al. | 704/500 |
| 2006/0140412 | A1 * | 6/2006 | Villemoes et al. | 381/12 |
| 2006/0190247 | A1 | 8/2006 | Lindblom | |
| 2006/0233379 | A1 * | 10/2006 | Villemoes | G10L 19/008 385/23 |
| 2006/0246868 | A1 * | 11/2006 | Taleb et al. | 455/303 |
| 2007/0171944 | A1 * | 7/2007 | Schuijers | G10L 19/008 370/537 |
| 2007/0194952 | A1 * | 8/2007 | Breebaart | G10L 19/008 341/50 |
| 2009/0125313 | A1 * | 5/2009 | Hellmuth | G10L 19/008 704/501 |
| 2009/0164222 | A1 * | 6/2009 | Kim | G10L 19/008 704/500 |
| 2009/0240504 | A1 * | 9/2009 | Pang | G10L 19/008 704/500 |
| 2010/0014679 | A1 * | 1/2010 | Kim | G10L 19/008 381/23 |
| 2011/0224994 | A1 * | 9/2011 | Norvell et al. | 704/500 |

FOREIGN PATENT DOCUMENTS

| | | | |
|---|---|---|---|
| JP | 2000028480 | A | 1/2000 |
| JP | 2005518566 | A | 6/2005 |
| JP | 2005522721 | A | 7/2005 |
| WO | 03073143 | A1 | 9/2003 |
| WO | 2004072956 | A1 | 8/2004 |
| WO | 2005/059901 | A1 | 6/2005 |
| WO | 2005/101370 | A1 | 10/2005 |
| WO | 2006/048203 | A1 | 5/2006 |
| WO | 2006070751 | A1 | 7/2006 |
| WO | 2006089570 | A1 | 8/2006 |
| WO | 2006/108573 | A1 | 10/2006 |
| WO | 2007/004830 | A1 | 1/2007 |
| WO | 2007/140809 | A1 | 12/2007 |
| WO | 2009038512 | A1 | 3/2009 |

OTHER PUBLICATIONS

Baumgarte, F., et al., "Binaural Cue Coding-Part I: Psychoacoustic Fundamentals and Design Principles", IEEE Transactions on Speech and Audio Processing, Nov. 1, 2003, pp. 509-519, vol. 11, No. 6, IEEE Signal Processing Society.

Samsidin, et al., "A Stereo to Mono Downmixing Scheme for MPEG-4 Parametric Stereo Encoder", 2006 IEEE International Conference on Acoustics, Speech and Signal Processing, May 14, 2006, pp. V529-V532, vol. 5, IEEE.

Herre, J., et al., "The Reference Model Architecture for MPEG Spatial Audio Coding", Audio Engineering Society Convention Paper 6447, May 28, 2005, pp. 1-13, Audio Engineering Society, Barcelona, Spain.

International Organization for Standardization, "Information technology—MPEG audio technologies—Part 1: MPEG Surround", Technical Corrigendum 2, International Standard ISO/IEC 23003-1:2007, Oct. 1, 2009, pp. 1-12, ISO.

Hotho, G., et al., "A Backward-Compatible Multichannel Audio Codec", IEEE Transactions on Audio, Speech, and Language Processing, Jan. 1, 2008, pp. 83-98, vol. 16, No. 1, IEEE Signal Processing Society.

Faller, C., et al., "Binaural cue coding applied to stereo and multichannel audio compression", Convention Paper, May 10, 2002, pp. 1-9, Audio Engineering Society, Munich, Germany.

Van Der Waal, R., et al. "Subband Coding for Stereophonic Digital Audio Signals", 1991 International Conference on Acoustics, Speech, and Signal Processing, Apr. 14, 1991, pp. 3601-3604 vol. 5, IEEE, Toronto, CA.

McCree, A., et al., "An Embedded Adaptive Multi-Rate Wideband Speech Coder", 2001 IEEE International Conference on Acoustics, Speech, and Signal Processing, May 7, 2001, pp. 761-764, vol. 2, IEEE, Salt Lake City, UT.

Koishida, K., et al., "A 16-KBit/S Bandwidth Scalable Audio Coder Based on the G.729 Standard", 2000 IEEE International Conference on Acoustics, Speech, and Signal Processing, Jun. 5, 2000, pp. 1149-1152, IEEE, Istanbul.

Dong, H. et al., "A Multiple Description Speech Coder Based on AMR-WB form Mobile Ad Hoc Networks", IEEE International Conference on Acoustics, Speech, and Signal Processing, May 17, 2004, pp. I-277-I-280, vol. 1, IEEE.

Chibani, M., et al., "Increasing the Rebustness of Celp-Based coders by Constrained Optimization", IEEE International Conference on Acoustics, Speech, and Signal Processing, Mar. 18, 2005, pp. 785-788, vol. 1, IEEE.

Herre, J., et al., "Overview of MPEG-4 Audio and Its Applications in Mobile Communications", 5th International Conference on Signal Processing Proceedings, Aug. 21, 2000, pp. 11-20, vol. 1, IEEE, Beijing.

Kovesi, B., et al., "A Scalable Speech and Audio Coding Scheme with Continuous Bitrate Flexibility", IEEE International Conference on Acoustics, Speech, and Signal Processing, May 17, 2004, pp. I-273-1-276, vol. 1, IEEE.

Johansson, I., et al., "Bandwidth Efficient AMR Operation for VOIP", Speech Coding, 2002, IEEE Workshop Proceedings, Oct. 6, 2002, pp. 150-152, IEEE.

Recchione, M., "The Enhanced Variable Rate Coder: Toll Quality Speech for CDMA", International Journal of Speech Technology, May 1, 1999, pp. 305-315, vol. 2, issue 4, Kluwer Academic Publishers.

Uvliden, A., et al., "Adaptive Multi-Rate a Speech Service Adapted to Cellular Radio Network Quality", Conference Record of the Thirty-Second Asilomar Conference on Signals, Systems & Computers, Nov. 1, 1998, pp. 343-347, vol. 1, IEEE, Pacific Grove, CA, USA.

Chen, T., et al., "Experiments on QoS Adaptation for Improving End User Speech Perception Over Multi-hop Wireless Networks", IEEE International Conference on Communications, Jun. 6, 1999, pp. 708-715, vol. 2, IEEE, Vancouver, BC.

Dong, H., et al., "SNR and Bandwidth Scalable Speech Coding", International Symposium on Circuits and Systems, May 26, 2002, pp. II-859-II-862, vol. 2, IEEE, Phoenix-Scottsdale, AZ.

Baumgarte, F., et al., "Binaural Cue Coding—Part I: Psychoacoustic Fundamentals and Design Principles", IEEE Transactions on Speech and Audio Processing, Nov. 1, 2003, pp. 509-519, vol. 11 , Issue: 6, IEEE Signal Processing Society.

Sjober, J., et al., "Real-Time Transport Protocol (RTP) Payload Format and File Storage Format for the Adaptive Multi-Rate (AMR) and Adaptive Multi-Rate Wideband (AMR-WB) Audio Codecs", Network Working Group, Request for Comments: 3267, Jun. 1, 2002, pp. 1-41, The Internet Society.

Faller, C., "Parametric Miltichannel Audio Coding: Synthesis of Coherence Cues", IEEE Transactions on Audio, Speech, and Language Processing, Jan. 1, 2006, pp. 299-310, vol. 14, issue 1, IEEE.

* cited by examiner

ENERGY CONSERVATIVE MULTI-CHANNEL AUDIO CODING

TECHNICAL FIELD

The present invention relates to an audio encoding method and a corresponding audio decoding method, as well as an audio encoder and a corresponding audio decoder.

BACKGROUND

The need for offering telecommunication services over packet switched networks has been dramatically increasing and is today stronger than ever. In parallel there is a growing diversity in the media content to be transmitted, including different bandwidths, mono and stereo sound and both speech and music signals. A lot of efforts at diverse standardization bodies are being mobilized to define flexible and efficient solutions for the delivery of mixed content to the users. Noticeably, two major challenges still await solutions. First, the diversity of deployed networking technologies and user-devices imply that the same service offered for different users may have different user-perceived quality due to the different properties of the transport networks. Hence, improving quality mechanisms is necessary to adapt services to the actual transport characteristics. Second, the communication service must accommodate a wide range of media content. Currently, speech and music transmission still belong to different paradigms and there is a gap to be filled for a service that can provide good quality for all types of audio signals.

Today, scalable audiovisual and in general media content codecs are available, in fact one of the early design guidelines of MPEG was scalability from the beginning. However, although these codecs are attractive due to their functionality, they lack the efficiency to operate at low bitrates, which do not really map to the current mass market wireless devices. With the high penetration of wireless communications more sophisticated scalable-codecs are needed. This fact has been already realized and new codecs are to be expected to appear in the near future.

Despite the tremendous efforts being put on adaptive services and scalable codecs, scalable services will not happen unless more attention is given to the transport issues. Therefore, besides efficient codecs appropriate network architecture and transport framework must be considered as an enabling technology to fully utilize scalability in service delivery. Basically, three scenarios can be considered:

- Adaptation at the end-points. That is, if a lower transmission rate must be chosen the sending side is informed and it performs scaling or codec changes.
- Adaptation at intermediate gateways. If a part of the network becomes congested, or has a different service capability, a dedicated network entity as illustrated in FIG. 1, performs the transcoding of the service. With scalable codec this could be as simple as dropping or truncating media frames.
- Adaptation inside the network. If a router or wireless interface becomes congested adaptation is performed right at the place of the problem by dropping or truncating packets. This is a desirable solution for transient problems like handling of severe traffic bursts or the channel quality variations of wireless links.

Below, an overview of scalable codecs for speech and audio according to the prior art is given. We also give a general background on stereo coding concepts.

Scalable Audio Coding

Non-Conversational, Streaming/Download

In general the current audio research trend is to improve the compression efficiency at low rates (provide good enough stereo quality at bit rates below 32 kbps). Recent low rate audio improvements are the finalization of the Parametric Stereo (PS) tool development in MPEG, the standardization of a mixed CELP/and transform codec Extended AMR-WB (a.k.a. AMR-WB+) in 3GPP. There is also an ongoing MPEG standardization activity around Spatial Audio Coding (Surround/5.1 content), where a first reference model (RMO) has been selected [4].

With respect to scalable audio coding, recent standardization efforts in MPEG have resulted in a scalable to lossless extension tool, MPEG4-SLS. MPEG4-SLS provides progressive enhancements to the core AAC/BSAC all the way up to lossless with granularity step down to 0.4 kbps. An Audio Object Type (AOT) for SLS is yet to be defined. Further within MPEG a Call for Information (Cfl) has been issued in January 2005 [1] targeting the area of scalable speech and audio coding, in the Cfl the key issues addressed are scalability, consistent performance across content types (e.g. speech and music) and encoding quality at low bit rates (<24 kbps). Later, the scalable part was dropped and the work is now targeting a codec running at a variety of bitrates without embedded scalability.

Speech Coding (Conversational Mono)

General

In general speech compression the latest standardization efforts is an extension of the 3GPP2NMR-WB codec to also support operation at a maximum rate of 8.55 kbps. In ITU-T the Multirate G.722.1 audio/video conferencing codec has previously been updated with two new modes providing super wideband (14 kHz audio bandwidth, 32 kHz sampling) capability operating at 24, 32 and 48 kbps. Further standardization efforts were aiming to add an additional mode that would extend the bandwidth to 48 kHz full-band coding. The end result was the new stand-alone codec G.719, which provides low complex full-band coding from 32 to 128 kbps in steps of 16 kbps.

With respect to scalable conversational speech coding the main standardization effort is taking place in ITU-T, (Working Party 3, Study Group 16). There a scalable extension of G.729 was standardized in May 2006, called G.729.1. This extension is scalable from 8 to 32 kbps with 2 kbps granularity steps from 12 kbps. The main target application for G.729.1 is conversational speech over shared and bandwidth limited xDSL-links, i.e. the scaling is likely to take place in a Digital Residential Gateway that passes the VoIP packets through specific controlled Voice channels (Vc's). ITU-T has also recently (September 2008) approved the recommendation for a completely new scalable conversational codec, G.718. The codec comprises a core rate of 8.0 kbps and a maximum rate of 32 kbps., with scaling steps at 12.0, 16.0 and 24.0 kbps. The G.718 core is a WB speech codec inherited from VMR-WB, but also handles NB input signals by upsampling to the core samplerate. Further a joint extension of the G.718 and G.729.1 codecs that will bring super wideband and stereo capabilities (32 kHz sampling/2 channels) is currently under standardization in ITU-T (Working Party 3, Study Group 16, Question 23). The qualification period ended July 2008.

SNR Scalability

The principle of SNR scalability is to increase the SNR with increasing number of bits or layers. The two previously mentioned speech codecs G.729.1 and G.718 have this feature. Typically this is achieved by stepwise re-encoding of the coding residual from the previous layer. The embedded layered structure is attractive since lower bitrates can be decoded by simply discarding the upper layers. However, the embedded layering may not be optimal when considering the higher bitrates and a layered codec usually performs worse than a fixed bitrate codec at the same bitrate. Other codecs that can be mentioned here is the SNR scalable MPEG4-CELP and G.727 (Embedded ADPCM).

Bandwidth Scalability

There are also codecs that can increase bandwidth with increasing amount of bits, e.g. G722 (Sub band ADPCM) but also G.729.1 and G.718. G.729.1 operates with a cascaded CELP codec for the bitrates 8 and 12 kbps, but provides WB signals at 14 kbps using a bandwidth extension to fill the range from 4 kHz to 7 kHz. The bandwidth extension typically creates an excitation signal from the lower band by spectral folding or other mappings, which is further gain adjusted and shaped with a spectral envelope to simulate the higher end frequency spectrum. Although the solution might sound good, the extended spectrum does not generally match the input signal in an MSE sense. For codecs that also SNR scalable, the bandwidth extension used at lower rates is typically replaced with coded content in higher layers. This is the case for G.729.1 where the spectrum is gradually replaced with coded spectrum on a subband basis. G.718 exhibits the same feature and uses bandwidth extension from 6.4 kHz to 7.0 kHz for rates 8, 12 and 16 kbps. For the rates 24 and 32 kbps, the bandwidth extension is disabled and replaced with coded spectrum. Also in addition to being SNR-scalable MPEG4-CELP specifies a bandwidth scalable coding system for 8 and 16 kHz sampled input signals.

Audio Scalability

Basically, audio scalability can be achieved by:

Changing the quantization of the signal, i.e. SNR-like scalability.

Extending or tightening the bandwidth of the signal.

Dropping audio channels (e.g., mono consist of 1 channel, stereo 2 channels, surround 5 channels)—(spatial scalability).

Currently available, fine-grained scalable audio codec is the AAC-BSAC (Advanced Audio Coding—Bit-Sliced Arithmetic Coding). It can be used for both audio and speech coding, it also allows for bit-rate scalability in small increments.

It produces a bit-stream, which can even be decoded if certain parts of the stream are missing. There is a minimum requirement on the amount of data that must be available to permit decoding of the stream. This is referred to as base-layer. The remaining set of bits corresponds to quality enhancements, hence their reference as enhancement-layers. The AAC-BSAC supports enhancement layers of around 1 Kbit/s/channel or smaller for audio signals.

"To obtain such fine grain scalability, a bit-slicing scheme is applied to the quantized spectral data. First the quantized spectral values are grouped into frequency bands, each of these groups containing the quantized spectral values in their binary representation. Then the bits of the group are processed in slices according to their significance and spectral content. Thus, first all most significant bits (MSB) of the quantized values in the group are processed and the bits are processed from lower to higher frequencies within a given slice. These bit-slices are then encoded using a binary arithmetic coding scheme to obtain entropy coding with minimal redundancy." [1]

"With an increasing number of enhancement layers utilized by the decoder, providing more least significant bit (LSB) information refines quantized spectral data. At the same time, providing bit-slices of spectral data in higher frequency bands increases the audio bandwidth. In this way, quasi-continuous scalability is achievable." [1]

In other words, scalability can be achieved in a two-dimensional space.

Quality, corresponding to a certain signal bandwidth, can be enhanced by transmitting more LSBs, or the bandwidth of the signal can be extended by providing more bit-slices to the receiver. Moreover, a third dimension of scalability is available by adapting the number of channels available for decoding. For example, a surround audio (5 channels) could be scaled down to stereo (2 channels) which, on the other hand, can be scaled to mono (1 channels) if, e.g., transport conditions make it necessary.

Stereo Coding or Multi-Channel Coding

A general example of an audio transmission system using multi-channel (i.e. at least two input channels) coding and decoding is schematically illustrated in FIG. 2. The overall system basically comprises a multi-channel audio encoder 100 and a transmission module 10 on the transmitting side, and a receiving module 20 and a multi-channel audio decoder 200 on the receiving side.

The simplest way of stereophonic or multi-channel coding of audio signals is to encode the signals of the different channels separately as individual and independent signals, as illustrated in FIG. 3. However, this means that the redundancy among the plurality of channels is not removed, and that the bit-rate requirement will be proportional to the number of channels.

Another basic way used in stereo FM radio transmission and which ensures compatibility with legacy mono radio receivers is to transmit a sum signal (mono) and a difference signal (side) of the two involved channels.

State-of-the art audio codecs such as MPEG-1/2 Layer III and MPEG-2/4 AAC make use of so-called joint stereo coding. According to this technique, the signals of the different channels are processed jointly rather than separately and individually. The two most commonly used joint stereo coding techniques are known as 'Mid/Side' (M/S) Stereo and intensity stereo coding which usually are applied on sub-bands of the stereo or multi-channel signals to be encoded.

M/S stereo coding is similar to the described procedure in stereo FM radio, in a sense that it encodes and transmits the sum and difference signals of the channel sub-bands and thereby exploits redundancy between the channel sub-bands. The structure and operation of a coder based on M/S stereo coding is described, e.g., in U.S. Pat. No. 5,285,498 by J. D. Johnston.

Intensity stereo on the other hand is able to make use of stereo irrelevancy. It transmits the joint intensity of the channels (of the different sub-bands) along with some location information indicating how the intensity is distributed among the channels. Intensity stereo does only provide spectral magnitude information of the channels, while phase information is not conveyed. For this reason and since temporal inter-channel information (more specifically the inter-channel time difference) is of major psycho-acoustical relevancy particularly at lower frequencies, intensity stereo can only be used at high frequencies above e.g. 2 kHz. An intensity stereo coding method is described, e.g., in European Patent 0497413 by R. Veldhuis et al.

A recently developed stereo coding method is described, e.g., in a conference paper with title 'Binaural cue coding applied to stereo and multi-channel audio compression', 112th AES convention, May 2002, Munich (Germany) by C. Faller et al. This method is a parametric multi-channel audio coding method. The basic principle of such parametric techniques is that at the encoding side the input signals from the N channels c1, c2, . . . , cN are combined to one mono signal m. The mono signal is audio encoded using any conventional monophonic audio codec. In parallel, parameters are derived from the channel signals, which describe the multi-channel image. The parameters are encoded and transmitted to the decoder, along with the audio bit stream. The decoder first decodes the mono signal m' and then regenerates the channel signals c1', c2', cN', based on the parametric description of the multi-channel image.

The principle of the binaural cue coding (BCC[2]) method is that it transmits the encoded mono signal and so-called BCC parameters. The BCC parameters comprise coded inter-channel level differences and inter-channel time differences for sub-bands of the original multi-channel input signal. The decoder regenerates the different channel signals by applying sub-band-wise level and phase adjustments of the mono signal based on the BCC parameters. The advantage over e.g. M/S or intensity stereo is that stereo information comprising temporal inter-channel information is transmitted at much lower bit rates.

Another technique, described in U.S. Pat. No. 5,434,948 by C. E. Holt et al. uses the same principle of encoding of the mono signal and side information. In this case, side information consists of predictor filters and optionally a residual signal. The predictor filters, estimated by the LMS algorithm, when applied to the mono signal allow the prediction of the multi-channel audio signals. With this technique one is able to reach very low bit rate encoding of multi-channel audio sources, however at the expense of a quality drop.

The basic principles of parametric stereo coding are illustrated in FIG. 4, which displays a layout of a stereo codec, comprising a down-mixing module 120, a core mono codec 130, 230, a bitstream multiplexer/demultiplexer 150, 250 and a parametric stereo side information encoder/decoder 140, 240. The down-mixing transforms the multi-channel (in this case stereo) signal into a mono signal. The objective of the parametric stereo codec is to reproduce a stereo signal at the decoder given the reconstructed mono signal and additional stereo parameters.

In International Patent Application, published as WO 2006/091139, a technique for adaptive bit allocation for multi-channel encoding is described. It utilizes at least two encoders, where the second encoder is a multistage encoder. Encoding bits are adaptively allocated among the different stages of the second multi-stage encoder based on multi-channel audio signal characteristics.

A downmixing technique employed in MPEG Parametric Stereo in explained in [3]. Here the potential energy loss from channel cancellation in the downmix procedure is compensated with a scaling factor.

MPEG Surround [4][5] divides the audio coding into two partitions: one predictive/parametric part called the Dry component and a non-predictable/diffuse part called the Wet component. The Dry component is obtained using channel prediction from a down-mix signal which has been encoded and decoded separately. The Wet component may be either one of the following three: a synthesized diffuse sound signal generated from the prediction and decorrelating filters, a gain adjusted version of the predicted part or simply by the encoded prediction residual.

SUMMARY

Although many advances have been made in the field of audio codecs, there is still a general demand for improved audio codec technologies.

It is a general object to provide improved audio encoding and/or decoding technologies.

It is a specific object to provide an improved audio encoding method.

It is also a specific object to provide an improved audio decoding method.

It is another specific object to provide an improved audio encoder device.

It is yet another specific object to provide an improved audio decoder device.

These and other objects are met by the invention as defined by the accompanying patent claims.

In a first aspect, there is provided an audio encoding method based on an overall encoding procedure operating on signal representations of a set of audio input channels of a multi-channel audio signal having at least two channels. According to the audio encoding method, a first encoding process is performed for encoding a first signal representation, including a down-mix signal, of the set of audio input channels. Local synthesis is performed in connection with the first encoding process to generate a locally decoded down-mix signal including a representation of the encoding error of the first encoding process. A second encoding process is performed for encoding a second representation of the set of audio input channels, using at least the locally decoded down-mix signal as input. Input channel energies of the audio input channels are estimated, and at least one energy representation of the audio input channels is generated based on the estimated input channel energies of the audio input channels. The generated energy representation(s) is/are then encoded. Residual error signals from at least one of the encoding processes, including at least the second encoding process, are generated, and residual encoding of the residual error signals is performed in a third encoding process.

In this way, an effective overall encoding of the audio input can be achieved with the possibility of matching the output channels with the input channels in terms of energy and/or quality.

There is also provided a corresponding audio encoder device operating on signal representations of a set of audio input channels of a multi-channel audio signal having at least two channels. Basically, the audio encoder device comprises a first encoder for encoding a first representation, including a down-mix signal, of the set of audio input channels in a first encoding process, a local synthesizer for performing local synthesis in connection with the first encoding process to generate a locally decoded down-mix signal including a representation of the encoding error of the first encoding process, and a second encoder for encoding a second representation of the set of audio input channels in a second encoding process, using at least the locally decoded down-mix signal as input. The audio encoder device further comprises an energy estimator for estimating input channel energies of the audio input channels, an energy representation generator for generating at least one energy representation of the audio input channels based on the estimated input channel energies of the audio input channels, and an energy representation encoder for encoding the energy representation(s). The audio encoder device also comprises a residual generator for generating residual error signals from at least one of the encoding processes, including at least the second encoding process, and a residual encoder for performing residual encoding of the residual error signals in a third encoding process.

In a second aspect, there is provided an audio decoding method based on an overall decoding procedure operating on an incoming bit stream for reconstructing a multi-channel audio signal having at least two channels. According to the audio decoding method, a first decoding process is performed to produce at least one first decoded channel representation including a decoded down-mix signal based on a first part of the incoming bit stream. A second decoding process is performed to produce at least one second decoded channel representation based on estimated energy of the decoded down-mix signal and a second part of the incoming bit stream representative of at least one energy representation of audio input channels. Input channel energies of audio input channels are estimated based on the estimated energy of the decoded down-mix signal and the second part of the incoming bit stream representative of at least one energy representation of audio input channels. Residual decoding is performed in a third decoding process based on a third part of the incoming bit stream representative of residual error signal information to generate residual error signals. The residual error signals and decoded channel representations from at least one of the first and second decoding processes, including at least the second decoding process, are then combined, and channel energy compensation is performed at least partly based on the estimated input channel energies for generating the multi-channel audio signal.

In this way, it is possible to effectively reconstruct a multi-channel audio signal such that output channels are close to the input channels in terms of energy and/or quality.

There is also provided a corresponding audio decoder device operating on an incoming bit stream for reconstructing a multi-channel audio signal having at least two channels. Basically, the audio decoder device comprises a first decoder for producing at least one first decoded channel representation including a decoded down-mix signal based on a first part of the incoming bit stream, and a second decoder for producing at least one second decoded channel representation based on estimated energy of the decoded down-mix signal and a second part of the incoming bit stream representative of at least one energy representation of audio input channels. The audio decoder device further comprises an estimator for estimating input channel energies of audio input channels based on estimated energy of the decoded down-mix signal and the second part of the incoming bit stream representative of at least one energy representation of audio input channels. The audio decoder device also comprises a residual decoder for performing residual decoding in a third decoding process based on a third part of the incoming bit stream representative of residual error signal information to generate residual error signals. The audio decoder device also includes means for combining the residual error signals and decoded channel representations from at least one of the first and second decoding processes, including at least the second decoding process, and for performing channel energy compensation at least partly based on the estimated input channel energies for generating the multi-channel audio signal.

Other advantages offered by the invention will be appreciated when reading the below description of embodiments of the invention.

BRIEF DESCRIPTION OF THE DRAWINGS

The invention, together with further objects and advantages thereof, will be best understood by reference to the following description taken together with the accompanying drawings, in which.

DETAILED DESCRIPTION

The invention generally relates to multi-channel (i.e. at least two channels) encoding/decoding techniques in audio applications, and particularly to stereo encoding/decoding in audio transmission systems and/or for audio storage. Examples of possible audio applications include phone conference systems, stereophonic audio transmission in mobile communication systems, various systems for supplying audio services, and multi-channel home cinema systems.

The invention may for example be particularly applicable in future standards such as ITU-T WP3/SG16/Q23 SWB/stereo extension for G.729.1 and G.718, but is of course not limited to these standards.

It may be useful to begin with an overview of some concepts of multi-channel and stereo codec techniques.

Figure 1:
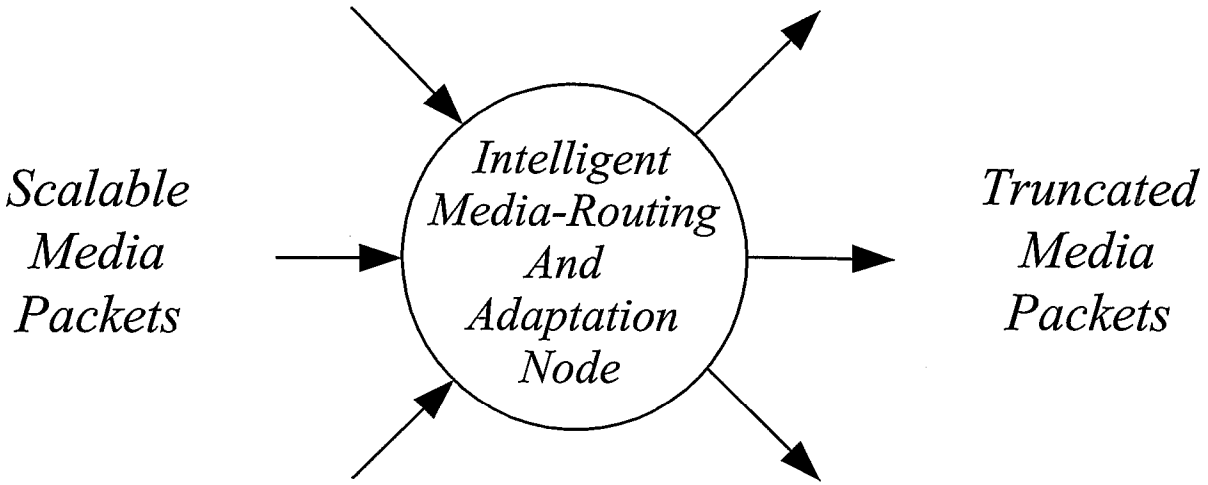
FIG. 1 illustrates an example of a dedicated network entity for media adaptation.
Figure 2:
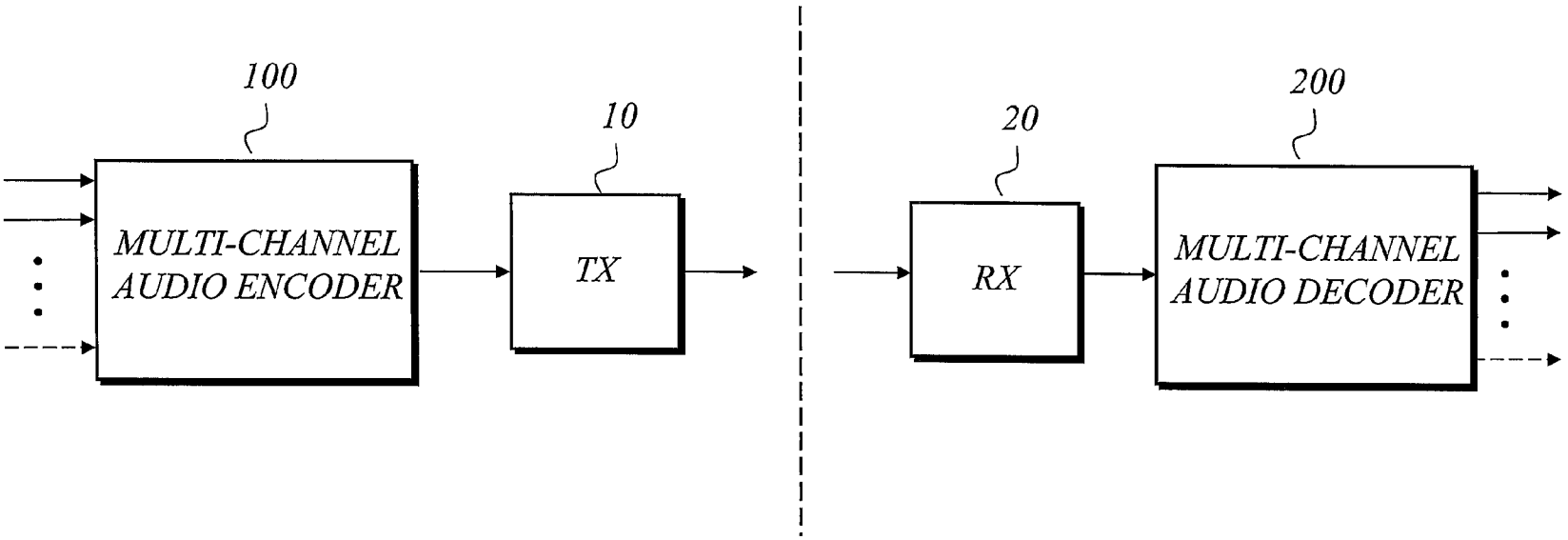
FIG. 2 is a schematic block diagram illustrating a general example of an audio transmission system using multi-channel coding and decoding.
Figure 3:
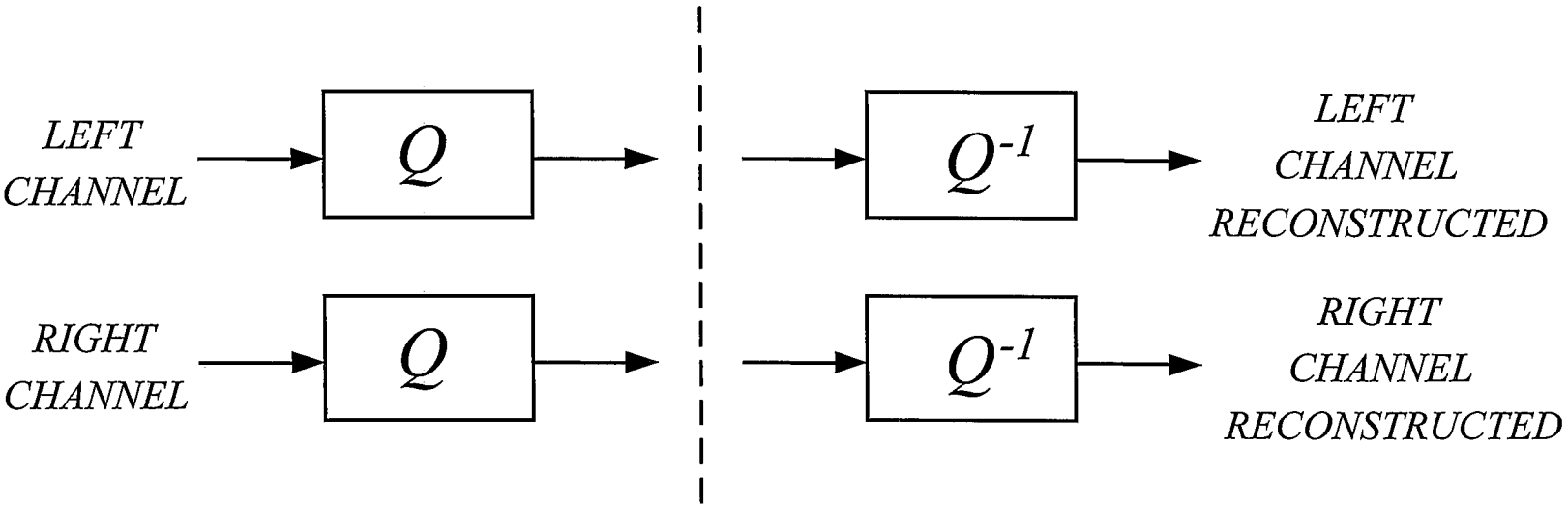
FIG. 3 is a schematic diagram illustrating how signals of different channels are encoded separately as individual and independent signals.
Figure 4:
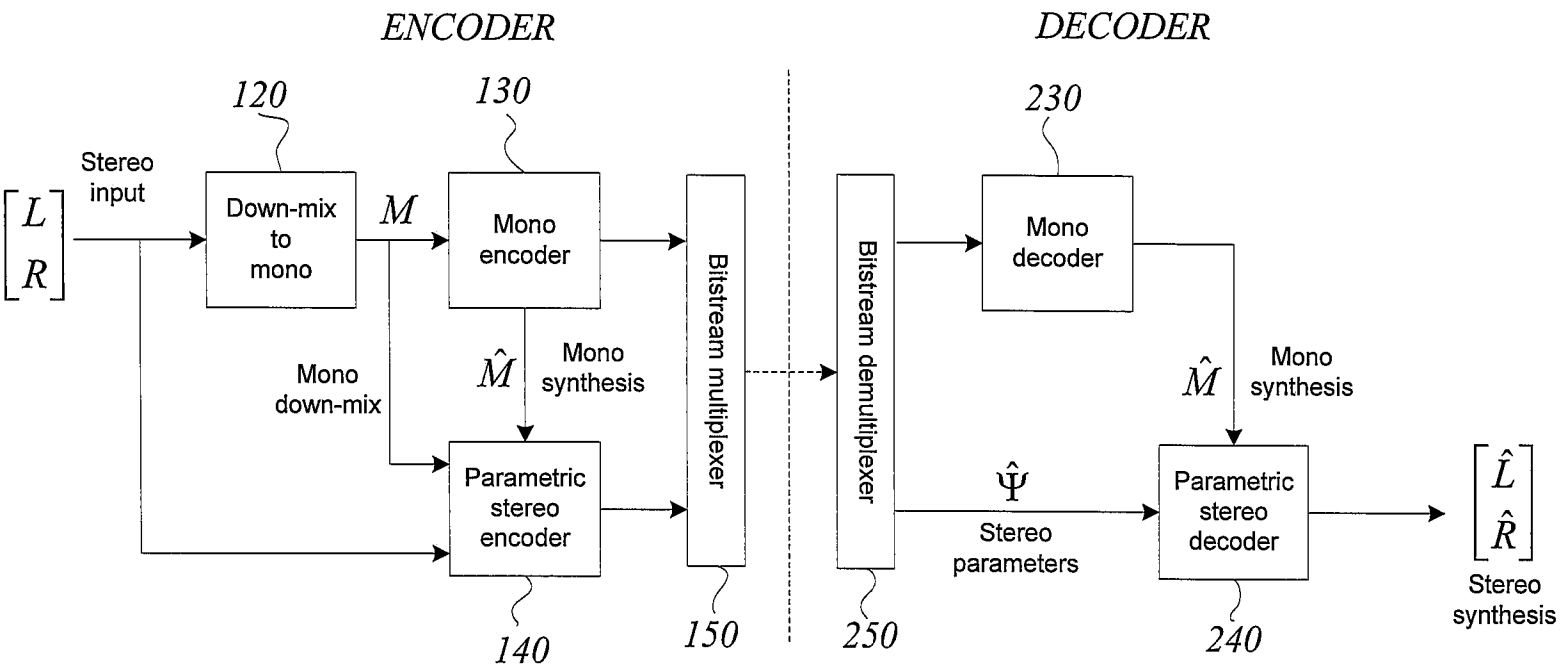
FIG. 4 is a schematic block diagram illustrating the basic principles of parametric stereo coding.
Figure 5:
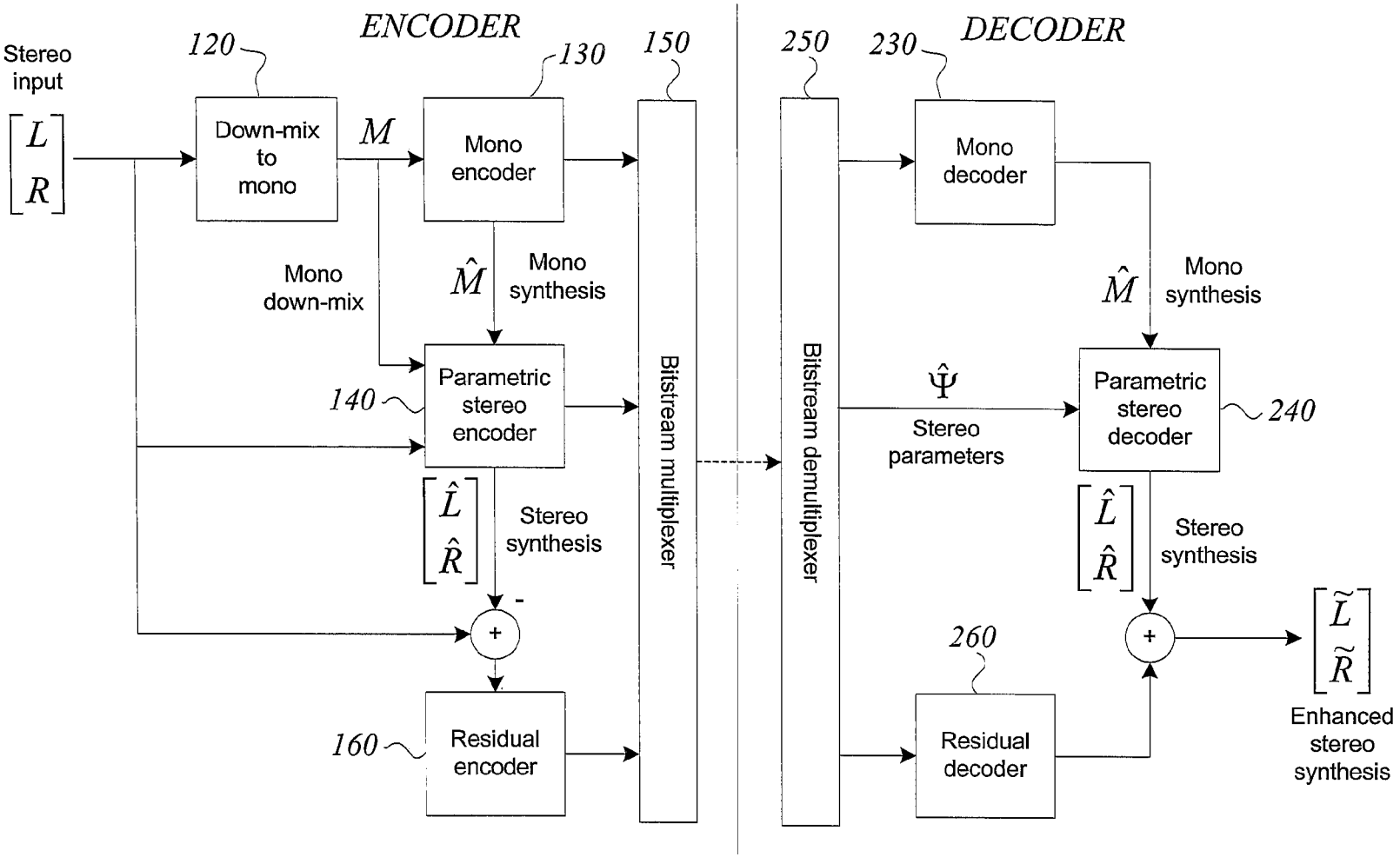
FIG. 5 is a schematic block diagram of a general stereo coder using a parametric prediction and a prediction/parametric residual encoding scheme.

In a stereo codec for example, the stereo encoding and decoding is normally performed in multiple stages. An overview of the process is depicted in FIG. 5. First, a down-mix mono signal M is formed from the left and right channels L, R. The mono signal is fed to a mono encoder from which a local synthesis $\hat{M}$ is extracted. Using the signals M, $\hat{M}$ and $[L\ R]^T$, a parametric stereo encoder produces a first approximation to the input channels $[\hat{L}\ \hat{R}]^T$. In the final stage, the prediction residual is calculated and encoded to provide further enhancement.

Channel Downmix

A standard way of down-mixing is to simply add the signals together:

$$m(n) = \frac{l(n) + r(n)}{2} \tag{1}$$

This type of down-mixing is applied directly on the time domain signal indexed by n. In general, the down-mix is a process of reducing the number of input channels p to a smaller number of down-mix channels q. The down-mix can be any linear or non-linear combination of the input channels, performed in temporal domain or in frequency domain. The down-mix can be adapted to the signal properties.

Other types of down-mixing use an arbitrary combination of the Left and Right channels and this combination may also be frequency dependent.

In exemplary embodiments of the invention the stereo encoding and decoding is assumed to be done on a frequency band or a group of transform coefficients. This assumes that the processing of the channels is done in frequency bands. An arbitrary down-mix with frequency dependent coefficients can be written as:

$$M_b(k)=\alpha_b L_b(k)+\beta_b R_b(k) \tag{2}$$

Here the index b represents the current band and k indexes the samples within that band. Without departing from the spirit of the invention, more elaborate down-mixing schemes may be used with adaptive and time variant weighting coefficients $\alpha_b$ and $\beta_b$.

Once the mono channel has been produced it is fed to the lower layer mono codec. The stereo encoder then uses the locally decoded mono signal to produce a stereo signal.

Channel Prediction

The two channels of a stereo signal are often very alike, making it useful to apply prediction techniques in stereo coding. Since the decoded mono channel $\hat{M}$ will be available at the decoder, the objective of the prediction is to reconstruct the left and right channel pair from this signal together with the transmitted quantized stereo parameters $\hat{\Psi}$.

$$\begin{bmatrix} \hat{L} \\ \hat{R} \end{bmatrix} = f(\hat{M}, \hat{\Psi}) \tag{3}$$

Subtracting the prediction from the original input signal at the encoder will form an error signal pair:

$$\begin{bmatrix} \varepsilon_L \\ \varepsilon_R \end{bmatrix} = \begin{bmatrix} L \\ R \end{bmatrix} - \begin{bmatrix} \hat{L} \\ \hat{R} \end{bmatrix} \tag{4}$$

For an MMSE perspective, the optimal prediction is obtained by minimizing the error vector $[\epsilon_L\ \epsilon_R]^T$. This can be solved in time domain by using a time varying FIR-filter:

$$\begin{bmatrix} \hat{l}(n) \\ \hat{r}(n) \end{bmatrix} = \begin{bmatrix} \sum_{i=0}^{N-1} h_{L,i}\hat{m}(n-i) \\ \sum_{i=0}^{N-1} h_{R,i}\hat{m}(n-i) \end{bmatrix} \tag{5}$$

The equivalent operation in frequency domain can be written:

$$\begin{bmatrix} \hat{L}_b(k) \\ \hat{R}_b(k) \end{bmatrix} = \begin{bmatrix} H_L(b,k)\hat{M}_b(k) \\ H_R(b,k)\hat{M}_b(k) \end{bmatrix} \tag{6}$$

where $H_L(b,k)$ and $H_R(b,k)$ are the frequency responses of the filters $h_L$ and $h_R$ for coefficient k of the frequency band b, and $\hat{L}_b(k)$, $\hat{R}_b(k)$ and $\hat{M}_b(k)$ are the transformed counterparts of the time signals $\hat{l}(n)$, $\hat{r}(n)$ and $\hat{m}(n)$.

Among the advantages of frequency domain processing is that it gives explicit control over the phase, which is relevant to stereo perception [2]. In lower frequency regions, phase information is highly relevant but can be discarded in the high frequencies. It can also accommodate a sub-band partitioning that gives a frequency resolution which is perceptually relevant. The drawbacks of frequency domain processing are the complexity and delay requirements for the time/frequency transformations. In cases where these parameters are critical, a time domain approach is desirable.

For the targeted codec according to this exemplary embodiment of the invention, the top layers of the codec are SNR enhancement layers in MDCT domain. The delay requirements for the MDCT are already accounted for in the lower layers and the part of the processing can be reused. For this reason, the MDCT domain is selected for the stereo processing. Although well suited for transform coding, it has some drawbacks in stereo signal processing since it does not give explicit phase control. Further, the time aliasing property of MDCT may give unexpected results since adjacent frames are inherently dependent. On the other hand, it still gives good flexibility for frequency dependent bit allocation. For accurate phase representation a combination of MDCT and MDST could be used. The additional MDST signal representation would however increase the total codec bitrate and processing load. In some cases the MDST can be approximated from the MDCT by using MDCT spectra from multiple frames.

For the stereo processing, the frequency spectrum is preferably divided into processing bands. In AAC parametric stereo, the processing bands are selected to match the critical bandwidths of human auditory perception. Since the available bitrate is low the selected bands are fewer and wider, but the bandwidths are still proportional to the critical bands. Denoting the band b, the prediction can be written:

$$\begin{bmatrix} \hat{L}_b'(k,m) \\ \hat{R}_b'(k,m) \end{bmatrix} = w_b(m)\hat{M}_b(k,m) = \begin{bmatrix} w_{b,L}(m) \\ w_{b,R}(m) \end{bmatrix} \hat{M}_b(k,m) \tag{7}$$

Here, k denotes the index of the MDCT coefficient in the band b and m denotes the time domain frame index. Here we let $[\hat{L}_b' \ \hat{R}_b']$ represent the prediction obtained with unquantized parameters $w_b(m)$.

The solution for $w_b(m)$ which is close to $[L_b \ R_b]^T$ in the mean square error sense is:

$$w_b(m) = \begin{bmatrix} E[L_b(m)\hat{M}_b^*(m)] \\ E[R_b(m)\hat{M}_b^*(m)] \end{bmatrix} \Big/ E\left[\hat{M}_b(m)\hat{M}_b^*(m)\right] \tag{8}$$

Here E[.] denotes the averaging operator and is defined as an example for an arbitrary time frequency variable as an averaging over a predefined time frequency region. For example:

$$E[X_b(m)] = \frac{1}{(2N_{Time}+1)\cdot BW(b)} \sum_{i=-N_{Time}}^{N_{Time}} \sum_{k \in Band(b)} X_b(k, m-i) \tag{9}$$

where each frequency band b is represented with the MDCT bins of the set Band(b) which has the size BW(b). Note that the frequency bands may also be overlapping.

The use of the coded mono signal $\hat{M}$ in the derivation of the prediction parameters includes the coding error in the calculation. Although sensible from an MMSE perspective, this may cause instability in the stereo image that is perceptually annoying. For this reason, the prediction parameters are based on the unprocessed mono signal, excluding the mono error from the prediction.

$$w_b'(m) = \begin{bmatrix} w_{b,L}'(m) \\ w_{b,R}'(m) \end{bmatrix} = \begin{bmatrix} E[L_b(m)M_b^*(m)] \\ E[R_b(m)M_b^*(m)] \end{bmatrix} \Big/ E[M_b(m)M_b^*(m)] \tag{10}$$

Using the downmix equation M=(L+R)/2 we can expand this expression, here for the left channel:

$$w_{b,L}' = \frac{E[L_b(m)M_b^*(m)]}{E[M_b(m)M_b^*(m)]} = \frac{E[L_b(m)(L_b(m)+R_b(m))^*]}{2E[M_b(m)M_b^*(m)]} \tag{11}$$

Since the signals L, R and M are in MDCT domain they are real valued and the complex conjugate (*) can be omitted.

$$w_{b,L}' = \frac{E[L_b(m)L_b(m)] + E[L_b(m)R_b(m))]}{2E[M_b(m)M_b(m)]} \tag{12}$$

Similarly, the right channel predictor coefficient can be written $$w_{b,L}' = \frac{E[R_b(m)R_b(m)] + E[L_b(m)R_b(m)]}{2E[M_b(m)M_b(m)]} \tag{13}$$

The expressions $E[L_b(m)L_b(m)]$ and $E[R_b(m)R_b(m)]$ corresponds to the energies of the left and right channels respectively and $E[L_b(m)R_b(m))]$ represents the cross-correlation in band b. Further, the sum of the predictor coefficients can be derived $$\begin{aligned} w_{b,L}' + w_{b,R}' &= \frac{E[L_b(m)L_b(m)] + E[L_b(m)R_b(m))]}{2E[M_b(m)M_b(m)]} + \frac{E[L_b(m)L_b(m)] + E[L_b(m)R_b(m)]}{2E[M_b(m)M_b(m)]} \\ &= \frac{E[L_b(m)L_b(m)] + 2E[L_b(m)R_b(m)] + E[R_b(m)R_b(m))]}{2E[M_b(m)M_b(m)]} \\ &= \frac{4E[M_b(m)M_b(m)]}{2E[M_b(m)M_b(m)]} \\ &= 2 \end{aligned} \tag{14}$$

The typical range of the channel predictor coefficients is [0,2], but the values may go beyond these bounds for strong negative cross-correlations. The relation in equation (14) shows that the MMSE channel predictors are connected and can be seen as a single parameter that pans the subband content to the left or right channel. Hence, the channel predictor could also be called a subband panning algorithm.

Since the spatial audio properties of a stereo or multichannel audio signal are likely to change with time, the spatial parameters are preferably encoded with a variable bit rate scheme. For stationary conditions the parameter bitrate can go down to a minimum and the saved bits can be used in parts of the codec, e.g. SNR enhancements.

It may be desirable to represent the channel predictors and the input channel energies in a way that keeps the energies of the synthesized channels stable with varying degree of residual coding. The details are further explained in the exemplary embodiments.

Residual Signal Encoding

The difference between the predicted stereo channels and the input channels will form a prediction residual.

$$\begin{bmatrix} \varepsilon_L \\ \varepsilon_R \end{bmatrix} = \begin{bmatrix} L \\ R \end{bmatrix} - \begin{bmatrix} \hat{L} \\ \hat{R} \end{bmatrix} \tag{15}$$

The residual signal contains the parts of the input channels which are not correlated with the mono down-mix channel and hence could not be modeled with prediction. Further, the prediction residual depends on the precision of the predictor function since a lower predictor resolution will likely give a larger error. Finally, since the prediction is based on the coded mono down-mix signal, the imperfections of the mono coder will also add to the residual error.

The components of the residual error signal show correlation and it is beneficial to exploit this correlation when coding the error, as described in the international patent application PCT/SE2008/000272, which is incorporated herein.

Other means of residual encoding can also be applied. The prediction residual often represents the diffuse sound field which cannot be predicted. From a perceptual perspective the inter channel correlation (ICC) [2][3][4] is important. This property can be simulated using the decoded down-mix signal or predicted/upmixed signal together with a system of decorrelating filters. The principles of this invention are applicable to any representation of the prediction residual.

Problem Analysis and Non-Limiting Examples of Embodiments

The inventors have made a thorough analysis of the state of the art of audio codecs to gain some useful insights in the function and performance of such codecs. In a multichannel multistage encoder, the signals will normally be composed of different components corresponding to the encoder stages. The quality of the decoded components is likely to vary with time due to limited bitrates and changing spatial properties but also the transmission conditions. If the resources are too scarce to represent a signal we can observe an energy loss, which will yield an unstable stereo image when it varies over time.

The downmix procedure used in for example MPEG PS [3] compensates for energy loss in the downmix due to channel cancellation, but does not give explicit control over the synthesized channel energies nor the prediction factors.

The approach in MPEG Surround [4][5] for example handles the presence of a prediction residual (Wet component) in combination with a parametric part (Dry component). The Wet component may be either 1) the gain adjusted parametric part, 2) the encoded prediction residual or 3) the parametric part passed through decorrelation filters. The solution in 3) can be seen as a parametric representation of the prediction residual. However, the system does not allow the three to coexist with varying proportion and hence does not offer built-in control of synthesis channel energies in this context.

Figure 18:
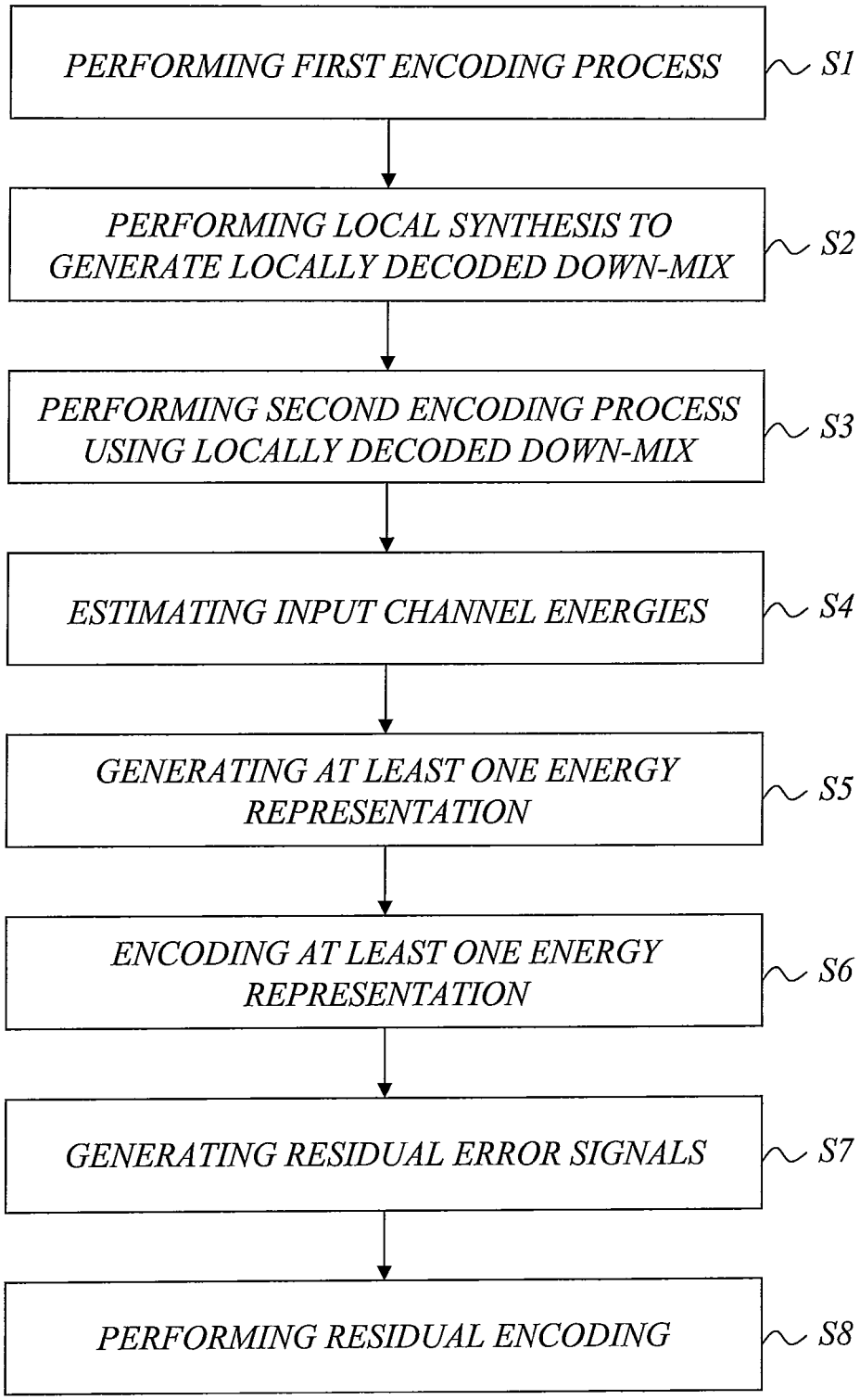
FIG. 18 is a schematic flow diagram illustrating an example of a method for audio encoding.
Figure 19:
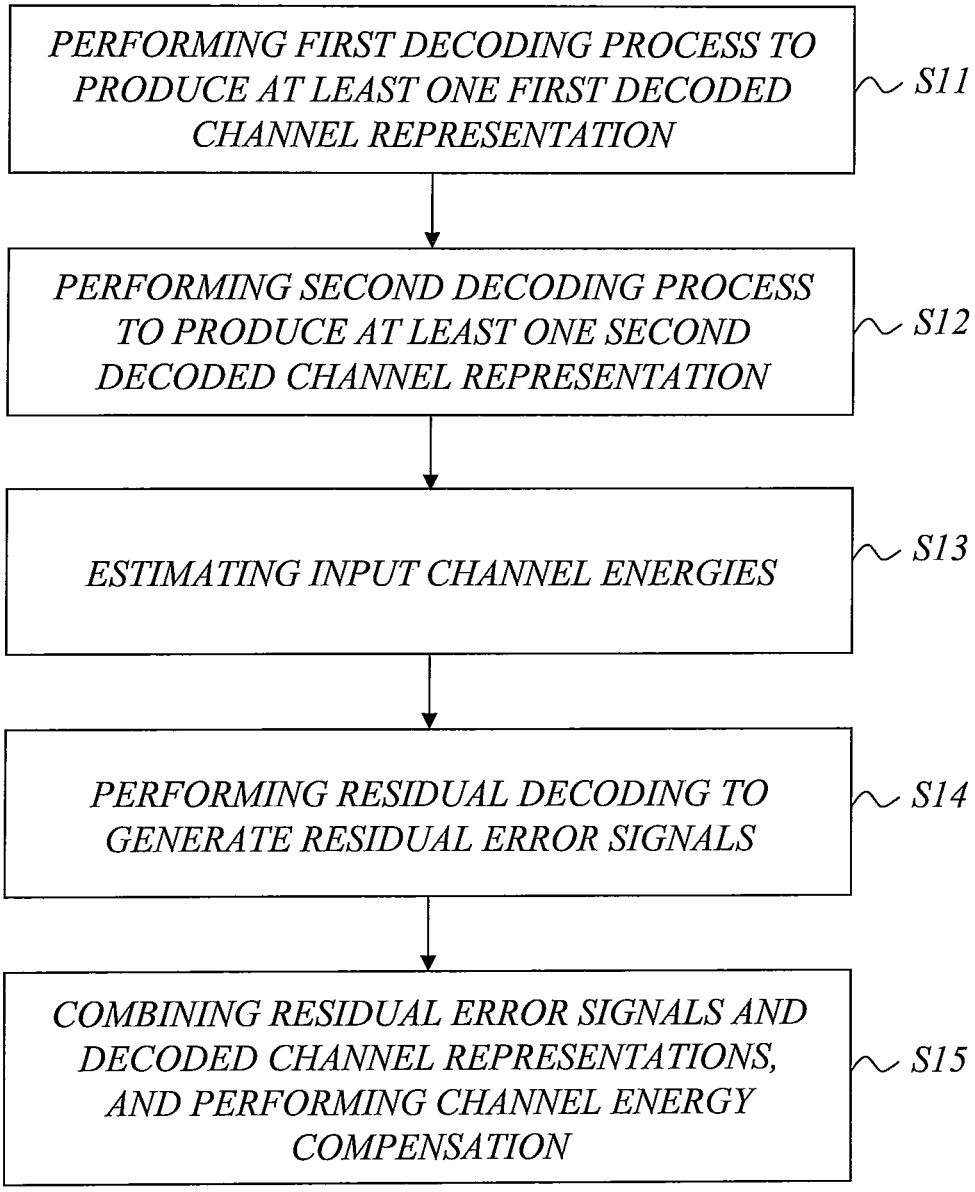
FIG. 19 is a schematic flow diagram illustrating an example of a method for audio decoding.

For a better understanding of the invention, it will be useful to introduce concepts of a novel class of audio encoding/decoding technologies with reference to the exemplary flow diagrams of FIGS. 18 and 19.

FIG. 18 is a schematic flow diagram illustrating an example of a method for audio encoding. The exemplary audio encoding method is based on an overall encoding procedure operating on signal representations of a set of audio input channels of a multi-channel audio signal having at least two channels. In step S1, a first encoding process is performed for encoding a first signal representation, including a down-mix signal, of said set of audio input channels. In step S2, local synthesis is performed in connection with the first encoding process to generate a locally decoded down-mix signal including a representation of the encoding error of the first encoding process. In step S3, a second encoding process is performed for encoding a second representation of the considered set of audio input channels, using at least the locally decoded down-mix signal as input. In step S4, input channel energies of the audio input channels are estimated. In step S5, at least one energy representation of the audio input channels is generated based on the estimated input channel energies of said audio input channels. In step S6, the generated energy representation(s) is/are encoded. In step S7, residual error signals from at least one of said encoding processes, including at least the second encoding process, are generated. In step S8, residual encoding of the residual error signals is performed in a third encoding process.

In this way, an effective overall encoding of the audio input channels is obtained. The energy representation(s) of the audio input channels enables matching of the energies of output channels at the decoding side with the estimated input channel energies. Preferably, the output channels are matched with the input channels both in terms of energy and quality.

In an exemplary embodiment, the steps of generating at least one energy representation and encoding the energy representation(s) are performed in the second encoding process, as will be exemplified in greater detail later on.

Normally, the overall encoding procedure is executed for each of a relatively large number of audio frames. It should however be understood that parts of the overall encoding procedure, such as the estimation and encoding (through a suitable energy representation) of the audio input channel energies, may be performed for a selectable sub-set of frames, and in one or more selectable frequency bands. In effect, this means that, for example, the steps of generating at least one energy representation and encoding the energy representation(s) may be performed for each of a number of frames in at least one frequency band.

In a particular example, the first encoding process is a down-mix encoding process, the second encoding process is based on channel prediction to generate one or more predicted channels, and the residual error signals thus includes residual prediction error signals. In this exemplary context, it has turned out to be especially advantageous to jointly represent and encode the estimated input channel energies and the prediction parameters of the channel prediction, in the second prediction-based encoding process.

Further, in the exemplary context of down-mix encoding combined with prediction-based encoding and residual encoding, there are many different realizations for the energy representation and energy encoding, each having its special advantages. In the following, three different exemplary realizations will be summarized briefly in the tables below, and described in more detail later on:

Example A

Energy Representation:
determining channel energy level differences;
determining channel energy level sums; and
determining delta energy measures based on the channel energy level sums and energy of the locally decoded down-mix signal from the local synthesis in connection with the first encoding process.
Energy Encoding:
quantizing the channel energy level differences; and
quantizing the delta energy measures.
Channel Prediction:
based on unquantized channel prediction parameters.

Example B

Energy Representation:
determining channel energy level differences;
determining channel energy level sums;
determining delta energy measures based on the channel energy level sums and energy of the locally decoded down-mix signal from the local synthesis in connection with the first encoding process; and
determining normalized energy compensation parameters based on the delta energy measures and energies of the predicted channels normalized by energy of the locally decoded down-mix signal;
Energy Encoding:
quantizing the channel energy level differences; and
quantizing the normalized energy compensation parameters.

Channel Prediction:

based on quantized channel prediction parameters derived from quantized channel energy level differences.

Example C

Energy Representation:

determining channel energy level differences; and determining energy-normalized input channel cross-correlation parameters.

Energy Encoding:

quantizing the channel energy level differences; and quantizing the energy-normalized input channel cross-correlation parameters.

Channel Prediction:

based on quantized channel prediction parameters derived from quantized channel energy level differences and quantized energy-normalized input channel cross-correlation parameters.

FIG. 19 is a schematic flow diagram illustrating an example of a method for audio decoding. The exemplary audio decoding method is based on an overall decoding procedure operating on an incoming bit stream for reconstructing a multi-channel audio signal having at least two channels. In step S11, a first decoding process is performed to produce at least one first decoded channel representation including a decoded down-mix signal based on a first part of said incoming bit stream. In step S12, a second decoding process is performed to produce at least one second decoded channel representation based on estimated energy of the decoded down-mix signal and a second part of the incoming bit stream representative of at least one energy representation of audio input channels. In step S13, input channel energies of audio input channels are estimated based on estimated energy of the decoded down-mix signal and the second part of the incoming bit stream representative of at least one energy representation of audio input channels. In step S14, residual decoding is performed in a third decoding process based on a third part of the incoming bit stream representative of residual error signal information to generate residual error signals. In step S15, the residual error signals and decoded channel representations from at least one of the first and second decoding processes, including at least the second decoding process, are combined, and channel energy compensation is performed at least partly based on the estimated input channel energies for generating the multi-channel audio signal.

This means that it is possible to effectively reconstruct a multi-channel audio signal such that output channels are close to the input channels in terms of energy and/or quality. In particular, the channel energy compensation may be performed to match the energies of output channels of the multi-channel audio signal with the estimated input channel energies. Preferably, however, the output channels of the multi-channel audio signal are matched with the corresponding input channels at the encoding side both in terms of energy and quality, wherein higher quality signals may be represented with a larger proportion than lower quality signals to improve the overall quality of the output channels.

In an exemplary embodiment, the channel energy compensation is integrated into the second decoding process when producing one or more second decoded channel representations. In this context, it is beneficial to estimate the energy of the decoded down-mix signal and energies of the residual error signals, and perform the second decoding process based on the energy of the decoded down-mix signal and the energies of the residual error signals.

In an alternative exemplary embodiment, the channel energy compensation is performed after combining the residual error signals and decoded channel representations. In this context, residual error signals and decoded channel representations from at least one of the first and second decoding processes are combined into a multi-channel synthesis and then energies of the combined multi-channel synthesis are estimated. Next, the channel energy compensation is performed based on the estimated energies of the combined multi-channel synthesis and the estimated input channel energies.

In a particular example, the second decoding process to produce at least one second decoded channel representation includes synthesizing predicted channels, and the residual decoding includes generating residual prediction error signals. In this exemplary context, the second decoding process to produce at least one second decoded channel representation includes deriving one or more one energy representations of the audio input channels from the second part of the incoming bit stream, estimating channel prediction parameters at least partly based on the energy representation(s), and then synthesizing predicted channels based on the decoded down-mix signal and the estimated channel prediction parameters.

In the following, three different exemplary realizations will be summarized briefly in the tables below, and described in more detail later on. The below decoding examples A-C generally correspond to the previously described encoding examples A-C.

Example A

Deriving Energy Representation:

deriving channel energy level differences and delta energy measures from the second part of the incoming bit stream.

Estimating Input Channel Energies:

based on estimated energy of the decoded down-mix signal, and the channel energy level differences and delta energy measures;

Estimating Channel Prediction Parameters:

based on estimated input channel energies, estimated energy of the decoded down-mix signal, and estimated energies of the residual error signals.

Example B

Deriving Energy Representation:

deriving channel energy level differences and normalized energy compensation parameters from the second part of the incoming bit stream.

Estimating Input Channel Energies:

based on estimated energy of the decoded down-mix signal, and the channel energy level differences and the normalized energy compensation parameters.

Estimating Channel Prediction Parameters:

based on the channel energy level differences.

Synthesizing Predicted Channels:

based on the decoded down-mix signal and the estimated channel prediction parameters.

Combining:

combining the residual error signals and the synthesized predicted channels into a combined multi-channel synthesis.

Channel Energy Compensation (After Combining):

estimating energies of the combined multi-channel synthesis, determining an energy correction factor based on estimated input channel energies and estimated energies of the combined multi-channel synthesis;

applying the energy correction factor to the combined multi-channel synthesis to generate the multi-channel audio signal.

Example C

Deriving Energy Representation:

deriving channel energy level differences and energy-normalized input channel cross-correlation parameters from the second part of the incoming bit stream.

Estimating Input Channel Energies:

based on estimated energy of the decoded down-mix signal, and the channel energy level differences and the energy-normalized input channel cross-correlation parameters.

Estimating Channel Prediction Parameters:

based on the channel energy level differences and the energy-normalized input channel cross-correlation parameters.

Synthesizing Predicted Channels:

based on the decoded down-mix signal and the estimated channel prediction parameters.

Combining:

combining the residual error signals and the synthesized predicted channels into a combined multi-channel synthesis.

Channel Energy Compensation (After Combining):

estimating energies of the combined multi-channel synthesis;

determining an energy correction factor based on estimated input channel energies and estimated energies of the combined multi-channel synthesis;

applying the energy correction factor to the combined multi-channel synthesis to generate the multi-channel audio signal.

Figure 20:
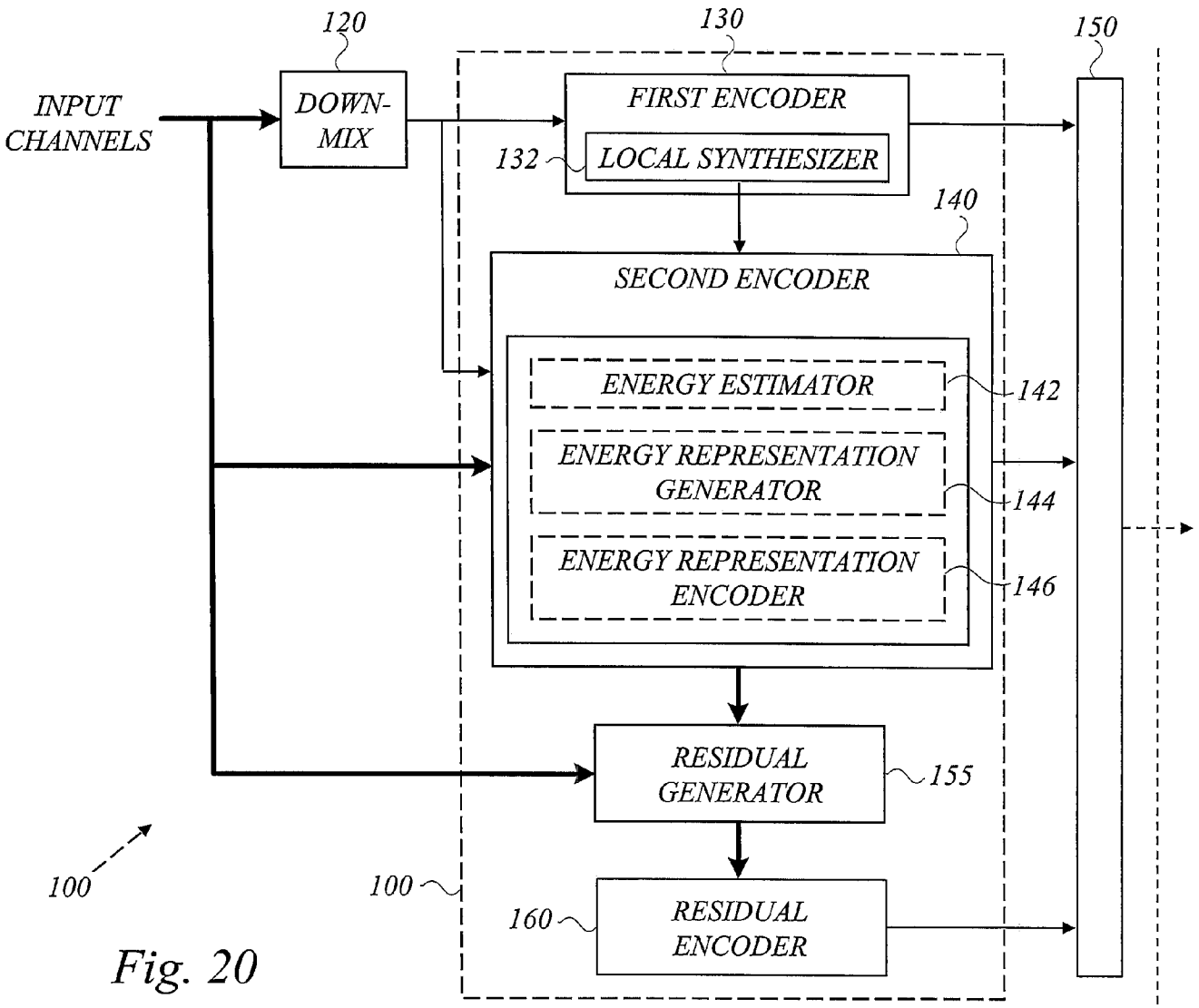
FIG. 20 is a schematic block diagram illustrating an example of an audio encoder device.
Figure 21:
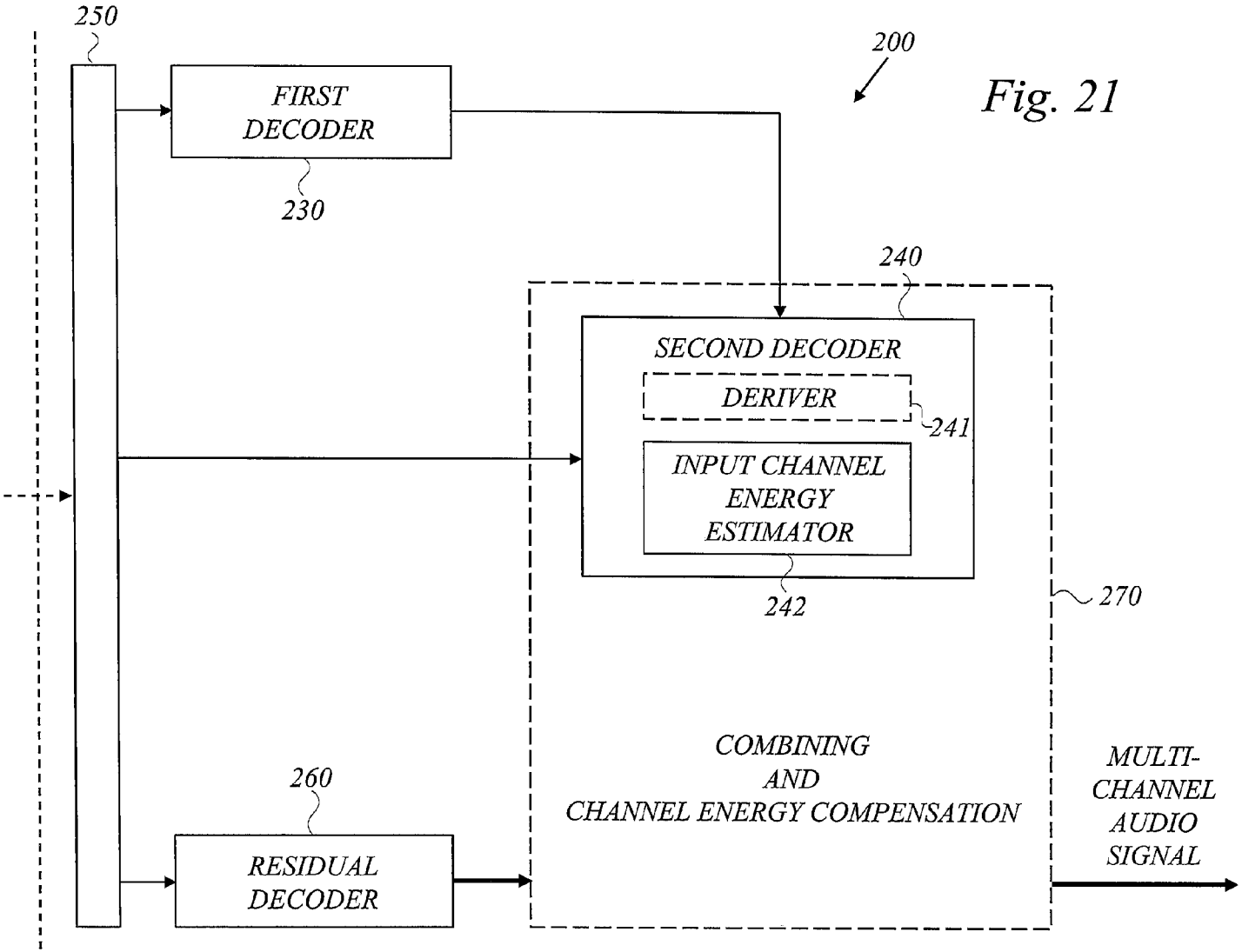
FIG. 21 is a schematic block diagram illustrating an example of an audio decoder device.

From a structural viewpoint, the invention relates to an audio encoder device and a corresponding audio decoder device, as will be exemplified with reference to the exemplary block diagrams of FIGS. 20 and 21.

FIG. 20 is a schematic block diagram illustrating an example of an audio encoder device. The audio encoder device 100 is configured for operating on signal representations of a set of audio input channels of a multi-channel audio signal having at least two channels.

The basic encoder device 100 includes a first encoder 130, a second encoder 140, energy estimator 142, an energy representation generator 144 and an energy representation encoder 146, a residual generator 155 and a residual encoder 160. The finally encoded parameters are normally collected by a multiplexer 150 for transfer to the decoding side.

The first encoder 130 is configured for receiving and encoding a first representation, including a down-mix signal, of audio input channels in a first encoding process. A down-mix unit 120 may be used for down-mixing a suitable set of the input channels into a down-mix signal. The down-mix-unit 120 may be regarded as an integral part of the basic encoder device 100, or alternatively seen as an "external" support unit.

Further, a local synthesizer 132 is arranged for performing local synthesis in connection with the first encoding process to generate a locally decoded down-mix signal including a representation of the encoding error of the first encoding process. The local synthesizer 132 is preferably integrated in the first encoder, but may alternatively be provided as a separate decoder implemented on the encoding side in connection with the first encoder.

The second encoder 140 is configured for receiving and encoding a second representation of the considered audio input channels in a second encoding process, using at least the locally decoded down-mix signal as input.

The energy estimator 142 is configured for estimating input channel energies of the considered audio input channels, and the energy representation generator 144 is configured for generating at least one energy representation of the audio input channels based on the estimated input channel energies of the audio input channels. The energy representation encoder 146 is configured for encoding the energy representation(s). In this way, the input channel energies may be estimated and encoded on the encoding side.

The energy estimator 142 may be implemented as an integrated part of the second encoder 140, may also be arranged as a dedicated unit outside the second encoder. In an exemplary embodiment, the energy representation generator 144 and the energy representation encoder 146 are conveniently implemented in the second encoder 140, as will be exemplified in more detail later on. In other embodiments, the energy representation processing may be provided outside the second encoder.

The residual generator 155 is configured for generating residual error signals from at least one of the encoding processes, including at least the second encoding process, and the residual encoder 160 is configured for performing residual encoding of the residual error signals in a third encoding process.

The energy representation(s) generated by the energy representation generator 144, and subsequently encoded, enables matching of the energies of output channels at the decoding side with the estimated input channel energies. Alternatively, the energy representation(s) enables matching of the output channels with the input channels both in terms of energy and quality.

The energy representation generator 144 and the energy representation encoder 146 are preferably configured to generate and encode the energy representation(s) for each of a number of frames in at least one frequency band. The energy estimator 142 may be configured for continuously estimating the input channel energies, or alternatively only for a selected set of frames and/or frequency bands adapted to the activities of the energy representation generator 144 and encoder 146.

In a particular example, the first encoder 130 is a down-mix encoder, and the second encoder 140 is a parametric encoder configured to operate based on channel prediction for generating one or more predicted channels, and the residual generator 155 is configured for generating residual prediction error signals. In this exemplary context, the second encoder 140 is preferably configured for jointly representing and encoding estimated input channel energies together with channel prediction parameters.

For the exemplary context of down-mix encoding combined with prediction-based encoding and residual encoding, three different exemplary realizations will be summarized below. Further details will be given later on.

Example A

In this example, the energy representation generator 144 includes a determiner for determining channel energy level differences, a determiner for determining channel energy level sums, and a determiner for determining so-called delta energy measures based on the channel energy level sums and energy of the locally decoded down-mix signal from the local synthesis in connection with the first encoding process. The energy representation encoder 146 includes a quantizer for quantizing the channel energy level differences, and a quantizer for quantizing the delta energy measures.

It may for example be beneficial for the second encoder 140 to perform channel prediction based on unquantized channel prediction parameters.

Example B

In this example, the energy representation generator 144 includes a determiner for determining channel energy level differences, a determiner for determining channel energy level sums, a determiner for determining delta energy measures based on the channel energy level sums and energy of the locally decoded down-mix signal from the local synthesis in connection with the first encoding process, and a determiner for determining so-called normalized energy compensation parameters based on the delta energy measures and energies of the predicted channels normalized by energy of the locally decoded down-mix signal. The energy representation encoder 146 includes a quantizer for quantizing the channel energy level differences, and a quantizer for quantizing the normalized energy compensation parameters.

For example, the second encoder 140 may be configured to perform channel prediction based on quantized channel prediction parameters derived from quantized channel energy level differences.

Example C

In this example, the energy representation generator 144 includes a determiner for determining channel energy level differences, and a determiner for determining energy-normalized input channel cross-correlation parameters. The energy representation encoder 146 includes a quantizer for quantizing the channel energy level differences, and a quantizer for quantizing the energy-normalized input channel cross-correlation parameters.

For example, the second encoder 140 may be configured to perform channel prediction based on quantized channel prediction parameters derived from quantized channel energy level differences and quantized energy-normalized input channel cross-correlation parameters.

FIG. 21 is a schematic block diagram illustrating an example of an audio decoder device. The audio decoder device 200 is configured for operating on an incoming bit stream for reconstructing a multi-channel audio signal having at least two channels. The incoming bitstream is normally received from the encoding side by a bitstream demultiplexer 250, which divides the incoming bitstream into relevant subsets or parts of the overall incoming bitstream.

The basic audio decoder device 200 comprises a first decoder 230, a second decoder 240, and input channel energy estimator 242, a residual decoder 260, and means 270 for combining and channel energy compensation.

The first decoder 230 is configured for producing one or more decoded channel representations including a decoded down-mix signal based on a first part of the incoming bit stream.

The second decoder 240 is configured for producing one or more second decoded channel representations based on estimated energy of the decoded down-mix signal and a second part of the incoming bit stream representative of at least one energy representation of the audio input channels.

The input channel energy estimator 242 is configured for estimating input channel energies of audio input channels based on estimated energy of the decoded down-mix signal and the second part of the incoming bit stream representative of at least one energy representation of the audio input channels.

The residual decoder 260 is configured for performing residual decoding in a third decoding process based on a third part of the incoming bit stream representative of residual error signal information to generate residual error signals.

The combining and channel energy compensation means 270 is configured for combining the residual error signals and decoded channel representations from at least one of the first and second decoders/decoding processes, including at least the second decoder/decoding process, and for performing channel energy compensation at least partly based on the estimated input channel energies in order to generate the multi-channel audio signal.

For example, the means 270 for combining and performing channel energy compensation may be configured to match the energies of output channels of the multi-channel audio signal with the estimated input channel energies. Preferably, however, the means 270 for combining and performing channel energy compensation is configured to match the output channels with the corresponding input channels at the encoding side both in terms of energy and quality, wherein higher quality signals are represented with a larger proportion than lower quality signals to improve the overall quality of the output channels.

As will be understood from the exemplary embodiments described later on, the overall structure for combining and channel energy compensation can be realized in several different ways.

For example, the channel energy compensation may be integrated into the second decoder. In this exemplary case, the second decoder 240 is preferably configured to operate based on the energy of the decoded down-mix signal and the energies of the residual error signals, implying that the audio decoder device 200 also comprises means for estimating energy of the decoded down-mix signal and energies of the residual error signals.

Alternatively, the decoder device includes a combiner for combining the residual error signals and the relevant decoded channel representations into a combined multi-channel synthesis, and a channel energy compensator for applying channel energy compensation on the combined multi-channel synthesis to generate the multi-channel audio signal. In this exemplary case, the audio decoder device preferably includes an estimator for estimating energies of the combined multi-channel synthesis, and the channel energy compensator is configured for applying channel energy compensation based on the estimated energies of the combined multi-channel synthesis and the estimated input channel energies.

In a particular example, the first decoder 230 is a down-mix decoder, the second decoder 240 is a parametric decoder configured for synthesizing predicted channels, and the residual decoder 260 is configured for generating residual prediction error signals. In this exemplary context, the second decoder 240 may include a deriver 241 (or may otherwise be configured) for deriving the energy representation(s) of the audio input channels from the second part of the incoming bit stream, an estimator for estimating channel prediction parameters at least partly based on the energy representation(s), and a synthesizer for synthesizing predicted channels based on the decoded down-mix signal and the estimated channel prediction parameters.

For the exemplary context of down-mix decoding combined with prediction-based decoding and residual decoding, three different exemplary realizations will be summarized below. Further details will be given later on.

Example A

In this example, the deriver 241 is configured for deriving channel energy level differences and delta energy measures from the second part of the incoming bit stream. The estimator 242 for estimating input channel energies is configured for estimating input channel energies based on estimated energy of the decoded down-mix signal, and the channel energy level differences and delta energy measures. The estimator for estimating channel prediction parameters is preferably configured for estimating channel prediction parameters based on estimated input channel energies, estimated energy of the decoded down-mix signal, and estimated energies of the residual error signals.

Example B

In this example, the deriver 241 is configured for deriving channel energy level differences and normalized energy compensation parameters from the second part of said incoming bit stream. The estimator 242 for estimating input channel energies is configured for estimating input channel energies based on estimated energy of the decoded down-mix signal, and the channel energy level differences and the normalized energy compensation parameters. The estimator for estimating channel prediction parameters is configured for estimating channel prediction parameters based on the channel energy level differences, and the synthesizer for synthesizing predicted channels is configured for synthesizing predicted channels based on the decoded down-mix signal and the estimated channel prediction parameters. In this example, the means 270 for combining and for performing channel energy compensation includes a combiner for combining the residual error signals and the synthesized predicted channels into a combined multi-channel synthesis, and a channel energy compensator. The channel energy compensator includes an estimator for estimating energies of the combined multi-channel synthesis, a determiner for determining an energy correction factor based on estimated input channel energies and estimated energies of the combined multi-channel synthesis, and an energy corrector for applying the energy correction factor to the combined multi-channel synthesis to generate the multi-channel audio signal.

Example C

In this example, the deriver 241 is configured for deriving channel energy level differences and energy-normalized input channel cross-correlation parameters from the second part of the incoming bit stream. The estimator 242 for estimating input channel energies is configured for estimating input channel energies based on estimated energy of the decoded down-mix signal, and the channel energy level differences and the energy-normalized input channel cross-correlation parameters. The estimator for estimating channel prediction parameters is preferably configured for estimating channel prediction parameters based on the channel energy level differences and the energy-normalized input channel cross-correlation parameters. The synthesizer for synthesizing predicted channels is configured for synthesizing predicted channels based on the decoded down-mix signal and the estimated channel prediction parameters. In this example, the means 270 for combining and for performing channel energy compensation includes a combiner for combining the residual error signals and the synthesized predicted channels into a combined multi-channel synthesis, and a channel energy compensator. In this example, the channel energy compensator includes an estimator for estimating energies of the combined multi-channel synthesis, a determiner for determining an energy correction factor based on estimated input channel energies and estimated energies of the combined multi-channel synthesis, an energy corrector for applying the energy correction factor to the combined multi-channel synthesis to generate the multi-channel audio signal.

In a particular example, the invention aims to solve at least one, and preferably both of the following two problems: to obtain optimal channel prediction and maintain explicit control over the output channel energies. The components of the signal may show individual variations over time in energy and quality, such that a simple adding of the signal components would give an unstable impression in terms of energy and overall quality. The energy and quality variations can have a variety of reasons out of which a few can be mentioned here:

- A signal component may be lost or degraded due to transmission conditions.
- Components of the signal could be deliberately attenuated in the encoder, knowing that the lost energy will be recovered in the decoder. Such attenuation may be based on for instance perceptual importance.
- Parts of the signal may be lost due to limitations in the overall encoder to represent them. Due to for instance limited bitrates or modeling capabilities, parts of the signal may fall outside of the scope of the overall encoder. Seen from a general perspective, the individual encoder and related decoder processes each represent a subspace which the true input signal is projected onto. The final residual or coding error is orthogonal to the union of the subspaces which represent the overall encoder and decoder. The final residual cannot be represented with these subspaces, but its energy can be estimated and compensated for if we know or can at least estimate the input energies and the energies of the received subspace components.

An efficient solution to these and other problems may for example be implemented by means of a joint representation and encoding of both the energies and prediction parameters in a way that is robust to the possible energy and quality variations of the different components, as previously mentioned.

The invention generally relates to an overall encoding procedure and associated decoding procedure. The encoding procedure involves at least two signal encoding processes operating on signal representations of a set of audio input channels. It also involves a dedicated process to estimate the energies of the input channels. A basic idea of the present invention is to use local synthesis in connection with a first encoding process to generate a locally decoded signal, including a representation of the encoding error of the first encoding process, and apply this locally decoded signal as input to a second encoding process. The sequence of encoding processes can be seen as refinement steps of the overall encoding process, or as capturing different properties of the signal.

For example, the first encoding process may be a main encoding process such as a mono encoding process or more generally a down-mix encoder, and the second encoding process may be an auxiliary encoding process such as a stereo encoding process or a general parametric encoding process. The overall encoding procedure operates on at least two (multiple) audio input channels, including stereophonic encoding as well as more complex multi-channel encoding.

Each encoding process is associated with a decoding process. In the overall decoding procedure the decoded signals from each encoding process are preferably combined such that the output channels are close to the input channels both in terms of energy and quality. Normally, the combination step also adapts to the possible loss of one or more signal representation in part or in whole, such that the energy and quality is optimized with the signals at hand in the decoder. In the combination step the qualities of the signal components may also be considered so that higher quality signals are represented with a larger proportion than the low quality signals, and thereby improving the overall quality of the output channels.

From a structural or implementational perspective, the invention relates to an encoder and an associated decoder. The overall encoder basically comprises at least two encoders for encoding different representations of input channels. Local synthesis in connection with a first encoder generates a locally decoded signal, and this locally decoded signal is applied as input to a second encoder. The overall encoder also generates energy representations of the input channels. The overall decoder includes decoding procedures associated with each encoding procedure in the encoder. It further includes a combination stage where the decoded components are combined with stable energy and quality, facing possible partial or total loss of one or more of the decoded signals.

The invention aims to solve at least one, and preferably both of the following two problems: to obtain optimal channel prediction and maintain explicit control over the output channel energies. The components of the signal may show individual variations over time in energy and quality, such that a simple adding of the signal components would give an unstable impression in terms of energy and overall quality.

A solution to these and other problems may for example be implemented by means of a joint representation and encoding of both the energies and prediction parameters in a way that is robust to the possible energy and quality variations of the different components.

In the following, non-limiting examples of different methods of obtaining the energy conservation will be presented, namely embodiments A, B and C. It should be understood that these embodiments are merely examples. For example, they are primarily focusing on stereo applications, and may thus be generalized for applications involving more than two audio channels. Common for these embodiments is that they preserve the synthesis energy with varying resolution on the residual encoding. Some of the differences of the exemplary embodiments are further discussed later on.

Figure 7:
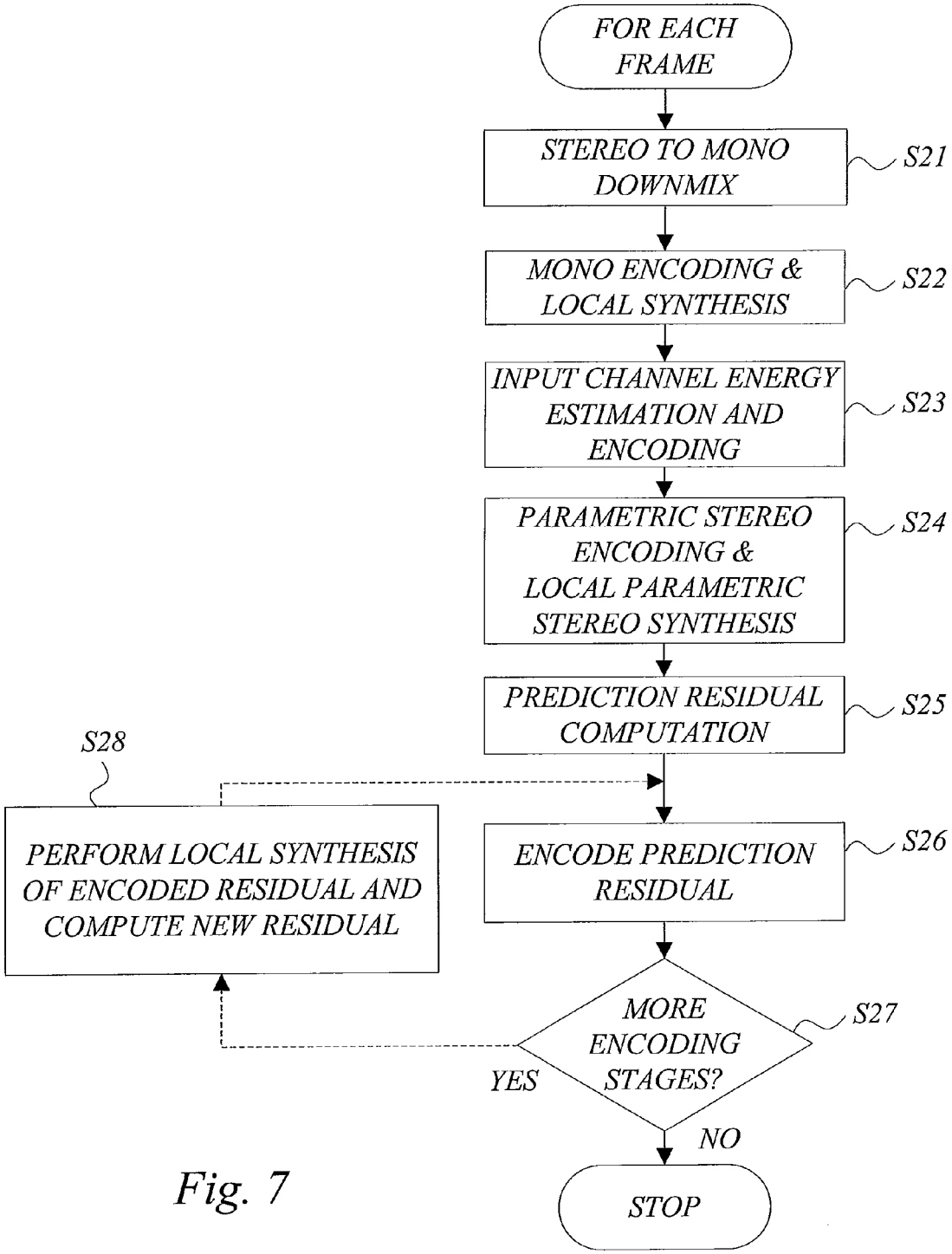
FIG. 7 illustrates an example of the encoder operation of the present invention in the form of a flowchart. The overview is valid for embodiments A, B and C.

An overview of an exemplary stereo case is presented in FIG. 7. In the first step S21, the encoder performs the downmix on the input signals and feeds it to the mono encoder, extracting a locally decoded downmix signal in step S22. It further estimates and encodes the input channel energies in step S23. Next, the channel prediction parameters are derived in step S24. In step S25 a local synthesis of the predicted/parametric stereo is created and subtracted from the input signals, forming a prediction/parametric residual which is encoded with suitable methods in step S26. Further iterative refinement steps may be taken if more encoding stages are possible in step S27. This is executed in step S28 by performing a local synthesis and subtracting the encoded prediction residual from the prediction residual from the previous iteration and encoding the new residual of the current iteration. The example encoder process depicted in FIG. 7 constitutes an overview which is valid for all presented embodiments A, B and C. It should however be noted that the underlying details of the steps outlined in FIG. 7 are different for each presented embodiment, as will be further explained.

An example decoder reconstructs the decoded downmix signal which is identical to the locally decoded downmix signal in the encoder. The input channel energies are estimated using the decoded down-mix signal together with encoded energy representation. The channel prediction parameters are derived. The decoder further analyses the energies of the synthesized signals and adjusts the energies to the estimated input channel energies. This step may also be incorporated in the channel prediction step as we shall see in embodiment A. Further, the process of energy adjustment may also consider the qualities of signal components, such that lower quality components may be suppressed in favour of higher quality components.

Expressed in the terms of [5] the invention may be regarded as a prediction based upmix which allows multiple components per channel, and further has the energy preserving properties of the energy based upmix.

The term "upmix", which is commonly used in the context of MPEG Surround, will be used synonymously with the expressions "channel prediction" and "parametric multichannel synthesis".

Although encoding/decoding is often performed on a frame-by-frame basis, it is possible to perform bit allocation and encoding/decoding on variable sized frames, allowing signal adaptive optimized frame processing.

The embodiments described below are merely given as examples, and it should be understood that the present invention is not limited thereto.

Exemplary Embodiment A

Figure 9A:
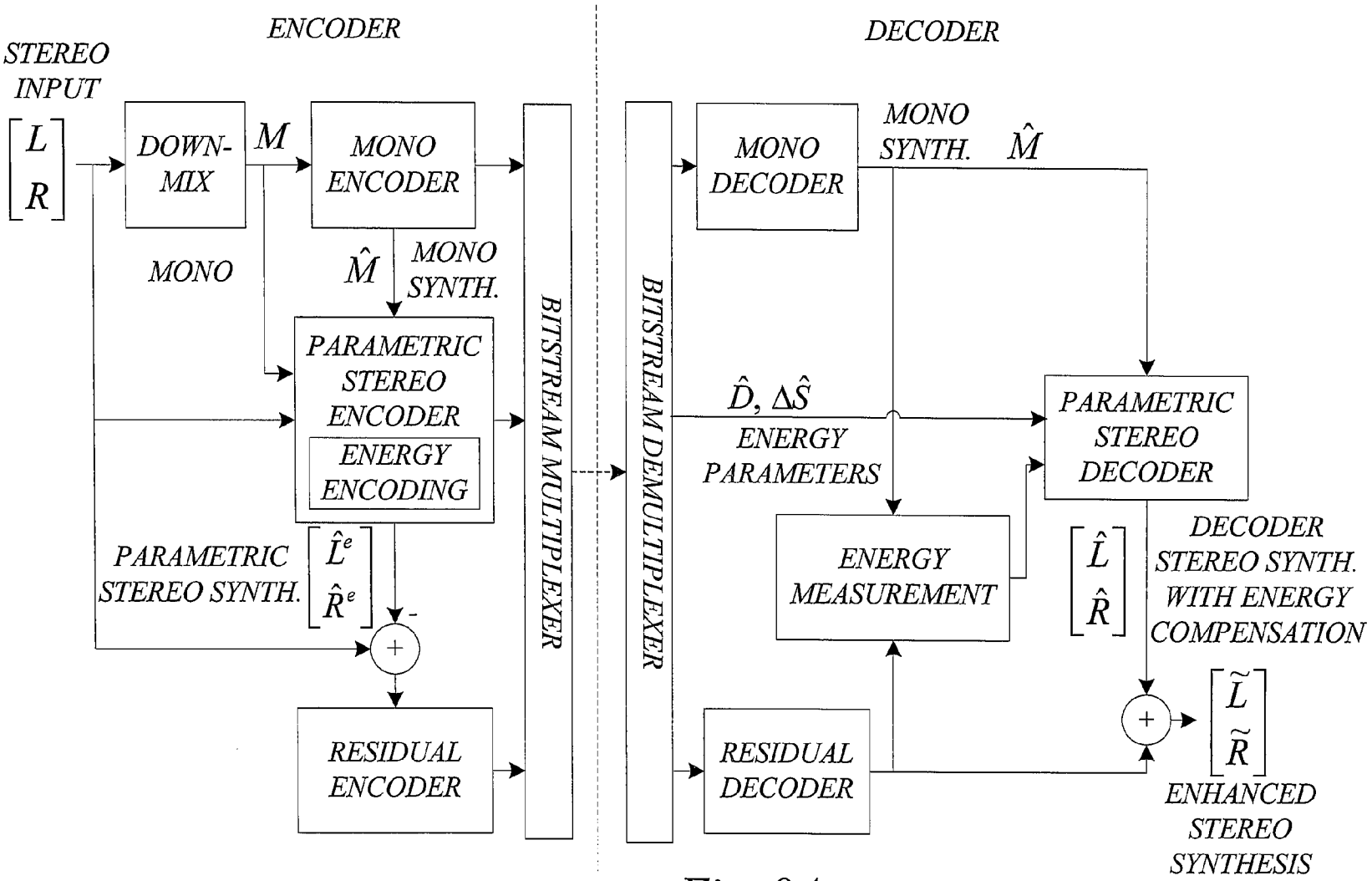
FIG. 9A is a schematic block diagram describing an example of the operation of the encoder and decoder for embodiment A.

In this non-limiting example the encoder and decoder operates on a stereo input and output signals respectively. An overview of this embodiment is presented in FIG. 9A. The encoder of FIG. 9A basically includes a down-mixer that creates a mono signal from the stereo input signals, a mono encoder which encodes the down-mix signal and produces a locally decoded down-mix synthesis. Further, it includes a parametric stereo encoder which creates a first representation of the input stereo channels using the locally decoded downmix signal and also estimates the input channel energies, creates an energy representation and encodes the representation to be used in the decoder. The encoder also creates a stereo prediction residual which is encoded with the residual encoder. The decoder of FIG. 9A includes a mono decoder which creates a decoded down-mix signal corresponding to the locally decoded down-mix signal of the encoder. It also includes a residual decoder which decodes the encoded stereo prediction residual. Finally, it includes an energy measurement unit and a parametric stereo decoder.

Figure 8:
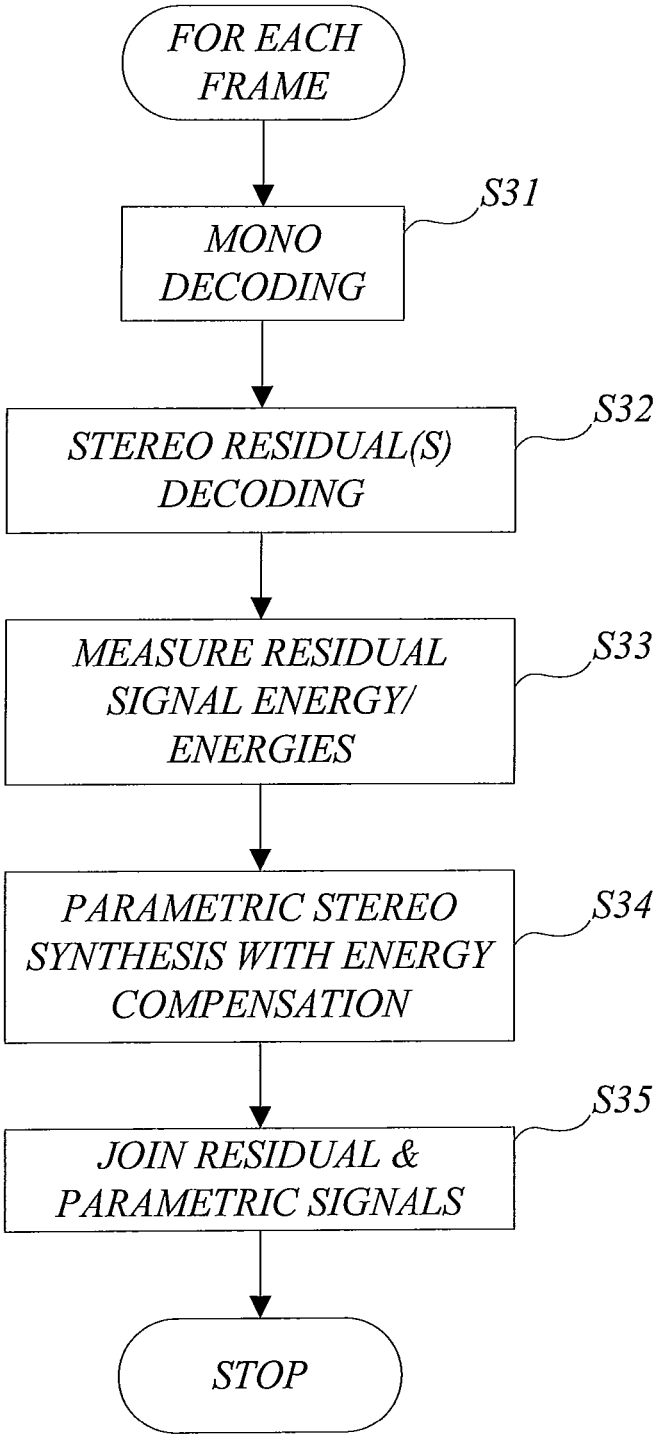
FIG. 8 is a flowchart that describes an example of the stereo synthesis chain in the decoder for embodiment A.

FIG. 8 explains the decoder operation in the form of a flowchart. In the first step S31 the mono decoding takes place, and the residual decoding is done in step S32. Step S33 includes the energy measurement of the residual signal energies. A parametric stereo synthesis with integrated energy compensation is done in step S34 and the joining of the decoded residuals and the parametric stereo synthesis is done in step S35. The energy encoding and decoding and channel prediction of embodiment A are explained in more detail below.

Energy Encoding and Decoding—Exemplary Embodiment A

For the purpose of energy encoding, we will first define the input channel energies. Let $\sigma_b^2(m)$ denote the per-sample energy of the input channels for frequency band b of frame index m.

$$\sigma_b^2(m) = \begin{bmatrix} \sigma_{b,L}^2(m) \\ \sigma_{b,R}^2(m) \end{bmatrix} = \begin{bmatrix} E[L_b(m)L_b(m)] \\ E[R_b(m)R_b(m)] \end{bmatrix} \tag{16}$$

In a practical implementation of the energy measurement, the bandwidth normalization will be equal for all energy parameters in one band and can hence be omitted.

The differences between energies in the left and right channels are perceptually important [2]. To gain explicit control over the energy balance we form the channel level differences (CLD) and channel level sums (CLS)

$$\begin{bmatrix} S_b(m) \\ D_b(m) \end{bmatrix} = \begin{bmatrix} \sigma_{b,L}^2(m) + \sigma_{b,R}^2(m) \\ \sigma_{b,L}^2(m)/\sigma_{b,R}^2(m) \end{bmatrix} \tag{17}$$

The CLDs $D_b(m)$ are preferably quantized in log domain using codebooks which consider perceptual measures for CLD sensitivity. The CLSs $S_b(m)$ show strong correlation with the energy of the down-mix signal $\sigma_{b,\hat{M}}^2(m)$. Since a decoded down-mix signal is available in the stereo decoder, we form a delta energy measure with respect to this signal $$\Delta S_b(m) = S_b(m)/\sigma_{b,\hat{M}}^2(m) = \frac{S_b(m)}{E\left[\hat{M}_b(m)\hat{M}_b(m)\right]} \tag{18}$$

Further, we note that S and D are dependent variables as illustrated in FIG. 60. For large values of D, the distribution of S becomes more narrow and different codebooks may be selected depending on the CLD. For extreme CLD values the CLS will be dominated by one channel and can be set to a constant using zero bits. For example:

If we assume:

$$\sigma_{b,L}^2(m) >> \sigma_{b,R}^2(m)$$

then it follows that $$M = \frac{L+R}{2} \approx \frac{L}{2}$$

$$\Delta S_b(m) = \frac{S_b(m)}{E\left[\hat{M}_b(m)\hat{M}_b(m)\right]} \approx \frac{E[L_b(m)L_b(m)]}{\frac{1}{4}E\left[\hat{L}_b(m)\hat{L}_b(m)\right]} \approx 4$$

Figure 6:
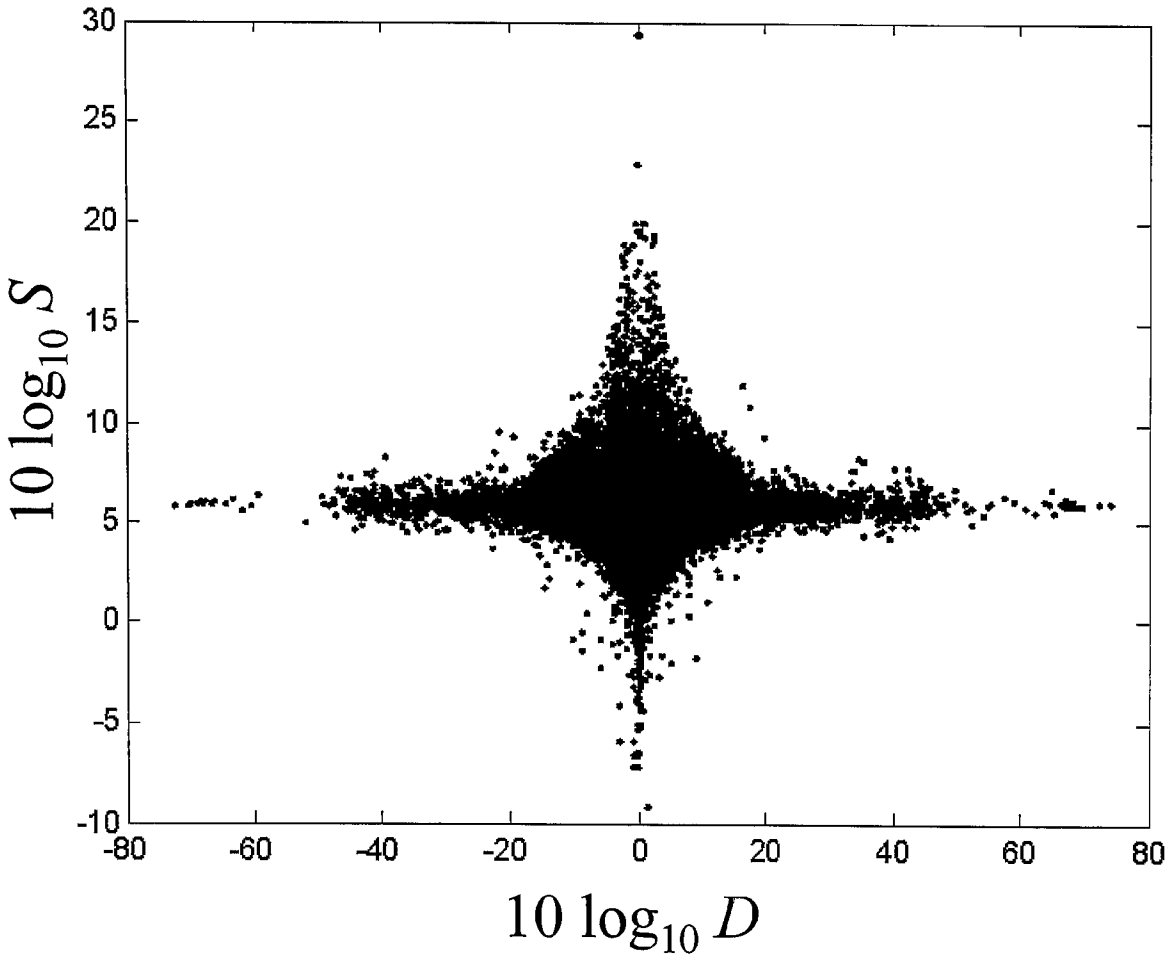
FIG. 6 is a scatter plot illustrating the dependencies between channel level difference (CLD) and channel level sums (CLS).

So for large CLDs the CLS will converge to a value of 4, corresponding to the 6 dB level we can observe in FIG. 6. The deviation from the 6 dB value is due to the coding noise in the mono downmix signal. The left channel energy is simply 6 dB lower than the mono energy, due to the downmix factor of ½. To exploit this dependency, we encode the CLS with different resolution depending on the quantized CLD. Since the CLS expresses an energy relation, we quantize this parameter in log domain.

The channel energies $[\sigma_{b,L}(m)\ \sigma_{b,R}(m)]^T$ can be expressed using the variables $D_b(m)$, $\Delta S_b(m)$ and $\sigma_{k,\hat{M}}^2(m)$ $$\begin{bmatrix} \sigma_{b,L}^2(m) \\ \sigma_{b,R}^2(m) \end{bmatrix} = \sigma_{b,\hat{M}}^2(m)\Delta S_b(m) \begin{bmatrix} \frac{D_b(m)}{1+D_b(m)} \\ \frac{1}{1+D_b(m)} \end{bmatrix} \tag{19}$$

In the decoder we can use the quantized parameters $\hat{D}_b(m)$ and $\Delta\hat{S}_b(m)$ to derive the estimated channel energies $\hat{\sigma}_b^2$ $$\hat{\sigma}_b^2 = \begin{bmatrix} \hat{\sigma}_{b,L}^2(m) \\ \hat{\sigma}_{b,R}^2(m) \end{bmatrix} = \sigma_{b,\hat{M}}^2(m)\Delta\hat{S}_b(m) \begin{bmatrix} \frac{\hat{D}_b(m)}{1+\hat{D}_b(m)} \\ \frac{1}{1+\hat{D}_b(m)} \end{bmatrix} \tag{20}$$

Channel Prediction—Exemplary Embodiment A

The channel prediction parameters $w_b'(m)$ used in the encoder are not quantized, thereby ensuring that the prediction residual is minimal. The error from the quantization of the prediction parameters is not transferred to the prediction residual.

Assuming the energies have been encoded and transmitted to the decoder together with the encoded down-mix signal, the channel prediction parameters can be estimated from the energies. The full stereo synthesis can be written $$\begin{bmatrix} \tilde{L}_b(m,k) \\ \tilde{R}_b(m,k) \end{bmatrix} = \begin{bmatrix} \hat{w}_{b,L}(m) \\ \hat{w}_{b,R}(m) \end{bmatrix} \hat{M}_b(m,k) + \begin{bmatrix} \hat{\varepsilon}_{b,L}(m,k) \\ \hat{\varepsilon}_{b,R}(m,k) \end{bmatrix} \tag{21}$$

where $[\hat{\epsilon}_{b,L}(m,k)\ \hat{\epsilon}_{b,R}(m,k)]^T$ are the quantized residual signals for frequency bin k of band b of frame index m, and $\hat{w}_b(m)$ are the channel prediction factors. The corresponding channel energies are $$\begin{bmatrix} \sigma_{b,L}^2(m) \\ \sigma_{b,R}^2(m) \end{bmatrix} = \begin{bmatrix} \hat{w}_{b,L}^2(m)E\left[\hat{M}_b(m)\hat{M}_b(m)\right] + E[\hat{\varepsilon}_{b,L}(m)\hat{\varepsilon}_{b,L}(m)] \\ \hat{w}_{b,R}^2(m)E\left[\hat{M}_b(m)\hat{M}_b(m)\right] + E[\hat{\varepsilon}_{b,R}(m)\hat{\varepsilon}_{b,R}(m)] \end{bmatrix} + \begin{bmatrix} 2E\left[\hat{w}_{b,L}(m)\hat{M}_b(m)\hat{\varepsilon}_{b,L}(m)\right] \\ 2E\left[\hat{w}_{b,R}(m)\hat{M}_b(m)\hat{\varepsilon}_{b,R}(m)\right] \end{bmatrix} = \begin{bmatrix} \hat{w}_{b,L}^2(m)\sigma_{b,\hat{M}}^2(m) + 2E\left[\hat{w}_{b,L}(m)\hat{M}_b(m)\hat{\varepsilon}_{b,L}(m)\right] + \sigma_{b,\hat{\varepsilon},L}^2(m) \\ \hat{w}_{b,R}^2(m)\sigma_{b,\hat{M}}^2(m) + 2E\left[\hat{w}_{b,R}(m)\hat{M}_b(m)\hat{\varepsilon}_{b,R}(m)\right] + \sigma_{b,\hat{\varepsilon},R}^2(m) \end{bmatrix} \tag{22}$$

Under high rate assumptions the prediction error $\epsilon$ will be uncorrelated with the predicted signal, i.e.

$$\begin{bmatrix} E\left[\hat{w}_{b,L}(m)\hat{M}_b(m)\hat{\varepsilon}_{b,L}(m)\right] \\ E\left[\hat{w}_{b,R}(m)\hat{M}_b(m)\hat{\varepsilon}_{b,R}(m)\right] \end{bmatrix} = 0$$

Using this assumption and substituting the true synthesis energies $[\sigma_{b,\tilde{L}}^2(m)\ \sigma_{b,\tilde{R}}^2(m)]^T$ with the quantized approximation $[\hat{\sigma}_{b,L}^2(m)\ \hat{\sigma}_{b,R}^2(m)]^T$, the equation above can be solved for $\hat{w}$:

$$\begin{bmatrix} \hat{w}_{b,L}(m) \\ \hat{w}_{b,R}(m) \end{bmatrix} = \begin{bmatrix} \pm\sqrt{\dfrac{\hat{\sigma}_{b,L}^2(m) - \sigma_{b,\hat{\varepsilon},L}^2(m)}{\sigma_{b,\hat{M}}^2(m)}} \\ \pm\sqrt{\dfrac{\hat{\sigma}_{b,R}^2(m) - \sigma_{b,\hat{\varepsilon},R}^2(m)}{\sigma_{b,\hat{M}}^2(m)}} \end{bmatrix} \tag{23}$$

Note that the sign of the square root is not known at the decoder and would also have to be encoded. However, for the typical input the prediction parameters are within the range [0,2] and assuming a positive sign will work well for most signals. This truncation can be achieved by limiting one of the prediction factors to [0,2] and obtaining the other factor using equation (14). If we wish to encode the sign we can exploit the fact that at most one of the channels may have a negative sign, e.g. by using a simple variable length code:

TABLE 1

Variable length codebook for coding the signs of the channel predictor coefficients. It exploits the high probability of two positive signs, as well as the fact that not two signs are negative in the same band.

| Signs | Codeword |
|---|---|
| (+ +) | 0 |
| (+ −) | 10 |
| (− +) | 11 |

Using this embodiment, the output channel energies are corrected using the channel prediction factors. If the decoded residual signal is close to the true residual, the channel prediction factors will be close to the optimal prediction factors used in the encoder. If the residual coding energy is lower than the true residual energy due to e.g. low bitrate encoding, the contribution from the parametric stereo is scaled up to compensate for the energy loss. If the residual coding is zero, the algorithm inherently defaults to intensity stereo coding.

Exemplary Embodiment B

Figure 9B:
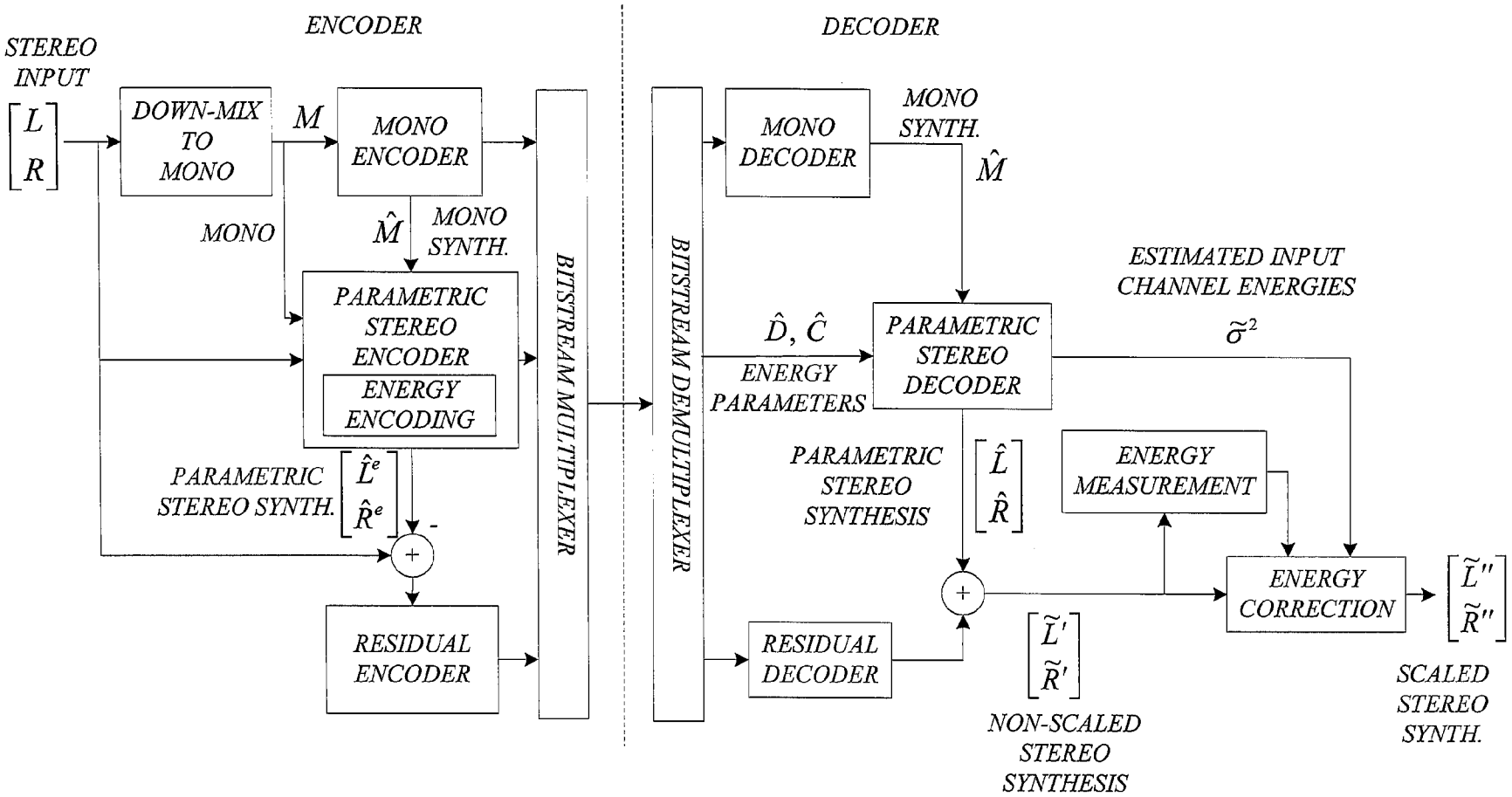
FIG. 9B illustrates an example of the operation of the encoder and decoder which is valid for embodiment B.

In this second non-limiting example the encoder and decoder also operates on stereo signals. An overview of this embodiment is presented in FIG. 9B, where the encoder of FIG. 9B basically includes a down-mixer that creates a mono signal from the stereo input signals, a mono encoder which encodes the down-mix signal and produces a locally decoded down-mix synthesis. Further, it includes a parametric stereo encoder which creates a first representation of the input stereo channels using the locally decoded down-mix signal and also estimates the input channel energies, creates an energy representation and encodes the representation to be used in the decoder. The encoder also creates a stereo prediction residual which is encoded with the residual encoder. The decoder of FIG. 9B includes a mono decoder which creates a decoded down-mix signal corresponding to the locally decoded down-mix signal of the encoder. It also includes a residual decoder which decodes the encoded stereo prediction residual. Further, it includes a parametric stereo decoder and an energy measurement unit which operates on the combined stereo synthesis and an energy correction unit which modifies the combined stereo synthesis to create a final stereo synthesis. The flowchart of FIG. 10 describes the steps of the decoder operation. The mono decoding is done in step S41, which is followed by a parametric stereo synthesis in step S42 and a stereo residual decoding in step S43. In step S44 the residual and parametric stereo synthesis is joined and the energy of this combined synthesis is done in step S45. Finally, step S46 includes the energy adjustment of the combined synthesis. The energy encoding and decoding and channel prediction of embodiment B are explained in more detail below.

Energy Encoding and Decoding—Exemplary Embodiment B

An optional strategy for encoding the energies can be derived. The CLDs $D_b(m)$ are derived as before. Next, we assume the CLD should be preserved on the predicted stereo contribution without residual encoding which gives us a relation for the channel prediction factors.

$$D_b(m) = \frac{E\lfloor (w_{b,L}(m)M_b(m))^2 \rfloor}{E\lfloor (w_{b,R}(m)M_b(m))^2 \rfloor} = \frac{w_{b,L}^2}{w_{b,R}^2} \tag{24}$$

Using equation (14) we can calculate the channel prediction factors from the CLDs $$\begin{bmatrix} w_{b,L} \\ w_{b,R} \end{bmatrix} = \begin{bmatrix} \dfrac{2\sqrt{D_b(m)}}{1+\sqrt{D_b(m)}} \\ \dfrac{2}{1+\sqrt{D_b(m)}} \end{bmatrix} \tag{25}$$

We note that a common scaling factor $C_b(m)$ on the synthesized stereo signals will not affect the CLD. Adding this factor to the synthesis we match the synthesized signal energies, again assuming there is no residual coding present.

$$\begin{bmatrix} \sigma_{b,L}^2(m) \\ \sigma_{b,R}^2(m) \end{bmatrix} = \begin{bmatrix} E\left[\left(C_b(m)w_{b,L}(m)\hat{M}_b(m)\right)^2\right] \\ E\left[\left(C_b(m)w_{b,R}(m)\hat{M}_b(m)\right)^2\right] \end{bmatrix} = \sigma_{b,\hat{M}}^2 C_b^2(m) \begin{bmatrix} w_{b,L}^2(m) \\ w_{b,R}^2(m) \end{bmatrix} \tag{26}$$

Equation (26) can be solved for $C_b(m)$ using either the left or the right channel:

$$C_b(m) = \sqrt{\frac{\sigma_{b,L}^2(m)}{\sigma_{b,\hat{M}}^2 w_{b,L}^2(m)}} = \frac{1}{w_{b,L}(m)}\sqrt{\frac{\sigma_{b,L}^2(m)}{\sigma_{b,\hat{M}}^2}}$$

$$C_b(m) = \sqrt{\frac{\sigma_{b,R}^2(m)}{\sigma_{b,\hat{M}}^2 w_{b,R}^2(m)}} = \frac{1}{w_{b,R}(m)}\sqrt{\frac{\sigma_{b,R}^2(m)}{\sigma_{b,\hat{M}}^2}}$$

These two equations give the same $C_b(m)$. We choose to use the higher energy channel which should give better numerical precision.

Equations (26) and (19) offer two expressions for the input channel energies. Taking the right side of the equality and setting them equal we get $$\sigma^2_{b,\hat{M}} C^2_b(m)\begin{bmatrix} w^2_{b,L}(m) \\ w^2_{b,R}(m)\end{bmatrix} = \sigma^2_{b,\hat{M}}(m)\Delta S_b(m)\begin{bmatrix} \frac{D_b(m)}{1+D_b(m)} \\ \frac{1}{1+D_b(m)}\end{bmatrix} = \sigma^2_{b,\hat{M}}(m)\Delta S_b(m)\begin{bmatrix} \frac{\frac{w^2_{b,L}(m)}{w^2_{b,R}(m)}}{1+w^2_{b,L}(m)/w^2_{b,R}(m)} \\ \frac{1}{1+w^2_{b,L}(m)/w^2_{b,R}(m)}\end{bmatrix} = \sigma^2_{b,\hat{M}}(m)\frac{\Delta S_b(m)}{w^2_{b,L}(m)+w^2_{b,R}(m)}\begin{bmatrix} w^2_{b,L}(m) \\ w^2_{b,R}(m)\end{bmatrix} \tag{27}$$

From this equation we identify $$C^2_b(m) = \frac{\Delta S_b(m)}{w^2_{b,L}(m)+w^2_{b,R}(m)} \tag{28}$$

where the denominator $w_{b,L}^2(m)+w_{b,R}^2(m)$ equals the sum of the energies of the predicted channels normalized by the mono energy. We conclude that this energy representation is equivalent to the first representation and that it only differs in the normalization of the CLS parameters $\Delta S_b(m)$ and $C_b^2(m)$. The CLD is encoded as in embodiment A. The energy compensation parameters, also referred to as normalized energy compensation parameters, $C_b^2(m)$ is also quantized in log domain just like $\Delta S_b(m)$, but uses a different codebook (in fact just a different log-value offset) due to the scaling difference.

The decoder derives the approximated channel energies $\tilde{\sigma}_b^2$ from the received parameters $\hat{C}_b^2(m)$, $\hat{D}_b(m)$ and measured decoded mono energy $\sigma_{b,\tilde{M}}^2(m)$ $$\tilde{\sigma}^2_b = \begin{bmatrix} \tilde{\sigma}^2_{b,L}(m) \\ \tilde{\sigma}^2_{b,R}(m)\end{bmatrix} = \sigma^2_{b,M}(m)\hat{C}_b(m)\begin{bmatrix} \left(\frac{2\sqrt{\hat{D}_b(m)}}{1+\sqrt{\hat{D}_b(m)}}\right)^2 \\ \left(\frac{2}{1+\sqrt{\hat{D}_b(m)}}\right)^2\end{bmatrix} \tag{29}$$

Channel Prediction—Exemplary Embodiment B

In the alternative scheme the channel predictors used in the encoder are derived from the quantized CLDs $$\begin{bmatrix} \tilde{w}_{b,L} \\ \tilde{w}_{b,R}\end{bmatrix} = \begin{bmatrix} \frac{2\sqrt{\hat{D}_b(m)}}{1+\sqrt{D_b(m)}} \\ \frac{2}{1+\sqrt{\hat{D}_b(m)}}\end{bmatrix} \tag{30}$$

In this case the same channel predictors are used in the encoder and decoder. This ensures correct matching between predicted channels and residual coding.

Decoder Energy Compensation—Exemplary Embodiment B

Since $\tilde{\sigma}_b^2$ was derived under the assumption of no residual coding, we must compensate for the residual coding energy if such is present in the decoder. First we synthesize the non-scaled stereo synthesis $$\begin{bmatrix} \tilde{L}'_b(m,k) \\ \tilde{R}'_b(m,k)\end{bmatrix} = \begin{bmatrix} \tilde{w}_{b,L}(m) \\ \tilde{w}_{b,R}(m)\end{bmatrix}\hat{M}_b(m,k) + \begin{bmatrix} \tilde{\varepsilon}_{b,L}(m,k) \\ \tilde{\varepsilon}_{b,R}(m,k)\end{bmatrix} \tag{31}$$

Note that the coded residuals $\tilde{\epsilon}$ differs from $\hat{\epsilon}$ in equation (20) since different predictors were used in the encoder. The final synthesis is produced by applying an energy correction factor that restores the approximated channel energies $$\begin{bmatrix} \tilde{L}''_b(m,k) \\ \tilde{R}''_b(m,k)\end{bmatrix} = \begin{bmatrix} \tilde{L}'_b(m,k)\sqrt{\tilde{\sigma}^2_{b,L}(m)/E[(\tilde{L}'_b(m,k))^2]} \\ \tilde{R}'_b(m,k)\sqrt{\tilde{\sigma}^2_{b,R}(m)/E[(\tilde{R}'_b(m,k))^2]}\end{bmatrix} \tag{32}$$

If the residual coding is zero, the energy correction factor will evaluate to 1. This method also compensates for the fact that the high rate assumption may not hold if the available bit rate is limited and the residual coding may show correlation with the predicted channels.

Exemplary Embodiment C

Figure 9C:
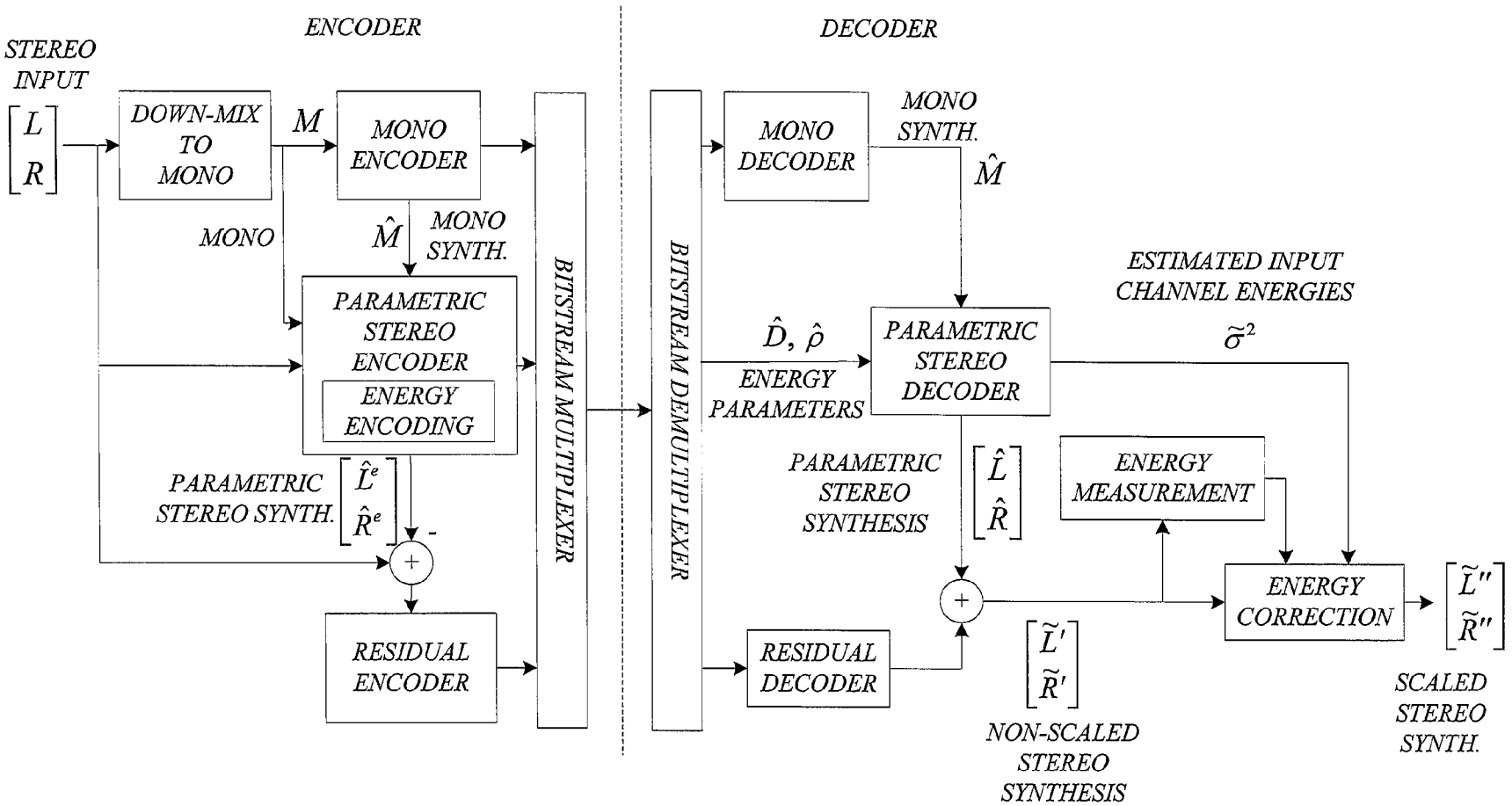
FIG. 9C illustrates an example of the operation of the encoder and decoder which is valid for embodiment C.
Figure 10:
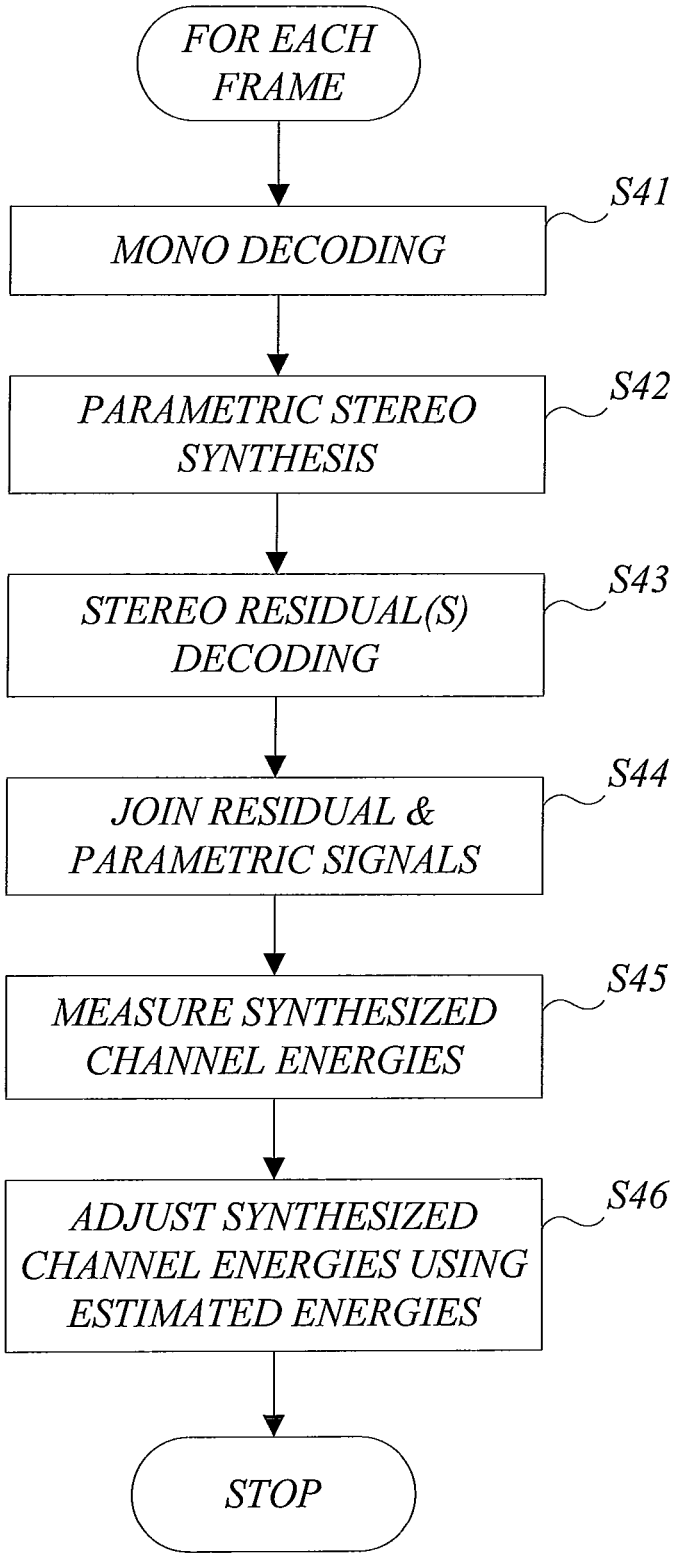
FIG. 10 illustrates an example of the decoder stereo synthesis chain valid for embodiments B and C.

The third non-limiting example is also a stereo encoder and decoder embodiment. The overview of this embodiment is presented in FIG. 9C, where the encoder of FIG. 9C basically includes a down-mixer that creates a mono signal from the stereo input signals, a mono encoder which encodes the down-mix signal and produces a locally decoded down-mix synthesis. Further, it includes a parametric stereo encoder which creates a first representation of the input stereo channels using the locally decoded down-mix signal and also estimates the input channel energies, creates an energy representation and encodes the representation to be used in the decoder. The encoder also creates a stereo prediction residual which is encoded with the residual encoder. The decoder of FIG. 9C includes a mono decoder which creates a decoded down-mix signal corresponding to the locally decoded down-mix signal of the encoder. It also includes a residual decoder which decodes the encoded stereo prediction residual. Further, it includes a parametric stereo decoder and an energy measurement unit which operates on the combined stereo synthesis and an energy correction unit which modifies the combined stereo synthesis to create a final stereo synthesis. From an overview perspective the decoder operation of embodiment C is similar to the decoder of embodiment B, and FIG. 10 gives an accurate description of the decoder steps for both examples. The energy encoding and decoding and channel prediction of embodiment C are explained in more detail below.

Energy Encoding and Decoding—Exemplary Embodiment C

From equations (12) and (13) we see that the channel predictor coefficients share one term, the normalized cross-correlation, also referred to as energy-normalized input channel cross-correlation, which we define as ρ

$$\rho_b(m) = \frac{E[L_b(m,k)R_b(m,k)]}{E[M_b(m,k)M_b(m,k)]} \tag{33}$$

Using the definition of $D_b(m)$ from equation (17) we can form yet an alternative channel energy expression $$\sigma_b^2 = \begin{bmatrix} \sigma_{b,L}^2(m) \\ \sigma_{b,R}^2(m) \end{bmatrix} = \sigma_{b,M}^2(m)(4-2\rho_b(m)) \begin{bmatrix} \frac{D_b(m)}{1+D_b(m)} \\ \frac{1}{1+D_b(m)} \end{bmatrix} \tag{34}$$

This can be rewritten as a straight-line equation which shows that the energy decreases proportionally to an increasing ρ.

$$\begin{bmatrix} \sigma_{b,L}^2(m) \\ \sigma_{b,R}^2(m) \end{bmatrix} = \begin{bmatrix} \frac{4\sigma_{b,M}^2(m)D_b(m)}{1+D_b(m)} - \rho_b(m)\frac{2\sigma_{b,M}^2(m)D_b(m)}{1+D_b(m)} \\ \frac{4\sigma_{b,M}^2(m)}{1+D_b(m)} - \rho_b(m)\frac{2\sigma_{b,M}^2(m)}{1+D_b(m)} \end{bmatrix} \tag{35}$$

If we assume that the energy is preserved in the mono encoding, i.e. $\sigma_{b,M}^2(m)=\sigma_{k,\hat{M}}^2(m)$ we can express the estimated channel energies in the decoder as $$\begin{bmatrix} \hat{\sigma}_{b,L}^2(m) \\ \hat{\sigma}_{b,R}^2(m) \end{bmatrix} = \begin{bmatrix} \frac{4\sigma_{b,\hat{M}}^2(m)D_b(m)}{1+D_b(m)} - \hat{\rho}_b(m)\frac{2\sigma_{b,\hat{M}}^2(m)D_b(m)}{1+D_b(m)} \\ \frac{4\sigma_{b,\hat{M}}^2(m)}{1+D_b(m)} - \hat{\rho}_b(m)\frac{2\sigma_{b,\hat{M}}^2(m)}{1+D_b(m)} \end{bmatrix} \tag{36}$$

This approach ensures that the quantized CLD $\hat{D}_b(m)$ is preserved, but it may have some energy instability due to the quantization noise in $\hat{\rho}_b(m)$ and the encoded mono $\hat{M}_b(m,k)$. Experience shows that sudden energy increases are more perceptually annoying than energy losses. This can be handled by constraining the quantization of ρ in the encoder such that the energy is never overestimated in the decoder.

$$\begin{cases} \hat{\sigma}_{b,L}^2(m)/\sigma_{b,L}^2(m) \le \sigma_{thr} \\ \hat{\sigma}_{b,R}^2(m)/\sigma_{b,R}^2(m) \le \sigma_{thr} \end{cases} \tag{37}$$

We select the $\hat{\rho}_b(m)$ as close as possible to $\rho_b(m)$ from equation (33) with the constraint $\hat{\sigma}_b^2(m)/\sigma_b^2(m) \le \sigma_{thr}$. We could ensure that the energy is never overestimated on any channel, i.e. fulfill both the lines in equation (37). Another strategy could be to make sure the energy is never overestimated in the lower energy channel, since an energy burst during almost silence is more perceptually annoying. From equation (35) we see that the energy estimate decreases with increasing ρ, which means we can start the search at the value given by equation (33) and perform an incremental search if the initial value does not fulfill $\hat{\sigma}_b^2(m)/\sigma_b^2(m) \le \sigma_{thr}$. If there is an energy loss in the mono encoding, we might want to search for decreasing ρ to minimize $\sigma_b^2(m)-\hat{\sigma}_b^2(m)$, but this may have an undesired effect on the channel prediction parameters. The effect on the channel prediction with varying ρ will be further discussed later on.

Channel Prediction—Exemplary Embodiment C

Using ρ and D, the MMSE optimal channel prediction factors can be written $$\begin{bmatrix} w_{b,L}(m) \\ w_{b,R}(m) \end{bmatrix} = \begin{bmatrix} \frac{2D_b(m)}{D_b(m)+1} + \rho_b(m)\left(\frac{1}{2} - \frac{D_b(m)}{D_b(m)+1}\right) \\ \frac{2}{D_b(m)+1} + \rho_b(m)\left(\frac{1}{2} - \frac{1}{D_b(m)+1}\right) \end{bmatrix} \tag{38}$$

Figure 11:
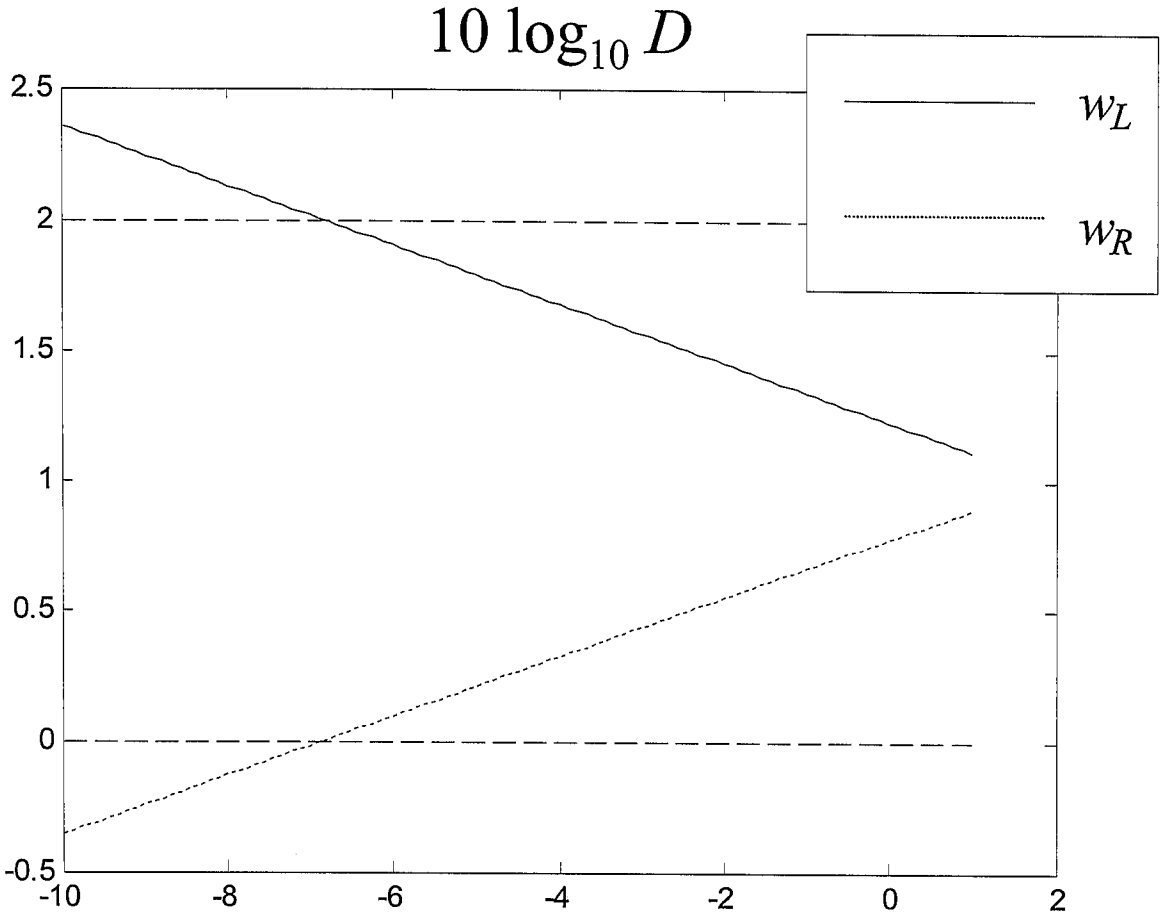
FIG. 11 is a plot that shows how the channel prediction factors (panning factors) varies with respect to the normalized cross-correlation coefficient.

We can note that for equal input channel energies D=1 the channel prediction coefficients become independent of ρ. In FIG. 11 we can see that the channel prediction parameters move towards the middle for increasing ρ. We can conclude that the method outlined in equation (37) is safe with respect to the channel prediction parameters, since a slight increase in ρ will only yield a prediction that with slightly increased channel leakage, but where the CLDs are still preserved.

Further we can note that for very large negative ρ, the channel prediction factors become insensitive to D. The dependencies between these variables can be exploited in order to give low distortion at a minimum bitrate.

Given the encoded $\hat{D}_b(m)$ and $\hat{\rho}_b(m)$ we derive the encoder channel prediction factors as $$\begin{bmatrix} \hat{w}_{b,L}(m) \\ \hat{w}_{b,R}(m) \end{bmatrix} = \begin{bmatrix} \frac{2\hat{D}_b(m)}{\hat{D}_b(m)+1} + \hat{\rho}_b(m)\left(\frac{1}{2} - \frac{\hat{D}_b(m)}{\hat{D}_b(m)+1}\right) \\ \frac{2}{\hat{D}_b(m)+1} + \hat{\rho}_b(m)\left(\frac{1}{2} - \frac{1}{\hat{D}_b(m)+1}\right) \end{bmatrix} \tag{39}$$

Like in embodiment B, the same channel predictors are used in both encoder and decoder. The difference from embodiment B is that the quantized MMSE optimal channel prediction factors are used. Further, as in embodiment B, the energy relations between the decoded residual and predicted channels are preserved.

Decoder Energy Compensation—Exemplary Embodiment C

The output channel energy are corrected after joining the predicted and residual coding components just like in embodiment B. Apart from the fact that different parameters are used for channel prediction and energy estimation, the overall description in the decoder flowchart of FIG. 100 is valid also for embodiment C. For embodiment C, reference can also be made to the block diagram of FIG. 9C, as mentioned above.

Differences Between Exemplary Embodiments A-C

The presented exemplary embodiments A, B and C give equal accuracy in representing the CLD in the synthesized stereo sound. They also have equivalent behavior in the case of no residual coding, in which case they all default to an intensity stereo algorithm. A main difference lies in which channel prediction parameters are used in the encoder, and how they are derived in the decoder. The preferred embodiment will be different depending on various parameters, e.g.

the available bitrate and the complexity of the input signals with regard to coding and spatial information.

In embodiment A, the optimal unquantized channel predictors are used in the encoder. The channel predictors used in the decoder will be the same if the bitrate is high and the residual coding approaches perfect reconstruction. For intermediate bitrates, only the predicted part of the stereo is scaled to compensate for energy loss in the residual. If the residual coding is noisier than the predicted stereo component due to e.g. low bitrate residual encoding, using a larger proportion of the predicted stereo is a desirable feature.

For embodiment B, the quantized channel predictors are used in the encoder. The prediction will not be optimal in the MMSE sense, but it guarantees that the scaling of the predicted signal and the coded residual signal is matched. This is important if the coding error of the mono signal is dominant and the residual mainly corrects this error.

The benefit of embodiment C is that it gives a compact representation of both the channel energies and the channel prediction factors. The parameters show dependencies that can be exploited for encoding. If the mono encoding is not conserving the energy of the mono signal, an additional safeguard for energy increases can be added with a predictable impact on the parametric stereo prediction performance.

Which one of these strategies is most beneficial may depend on the situation in terms of available bitrate and the typical input signal. For the SWB/stereo extension to G.718, it was found however that embodiment B was giving good results. These methods can also be combined, using different algorithms for different frequency bands. Such combinations could also be made adaptive, in which case the selected strategy would have to be signaled to the decoder. It could also be done without additional signaling if the strategy selection is performed using parameters that are already transmitted to the decoder.

Other encoding schemes could also be combined with the described methods.

The invention achieves scalability while maintaining channel energy levels which are important for stereo image perception. When the residual coding is nil, the system will default to an intensity stereo algorithm. As the residual coding increases, the synthesized output will scale towards perfect reconstruction while maintaining channel energies and stereo image stability.

AB Listening Test Evaluation

Figure 12:
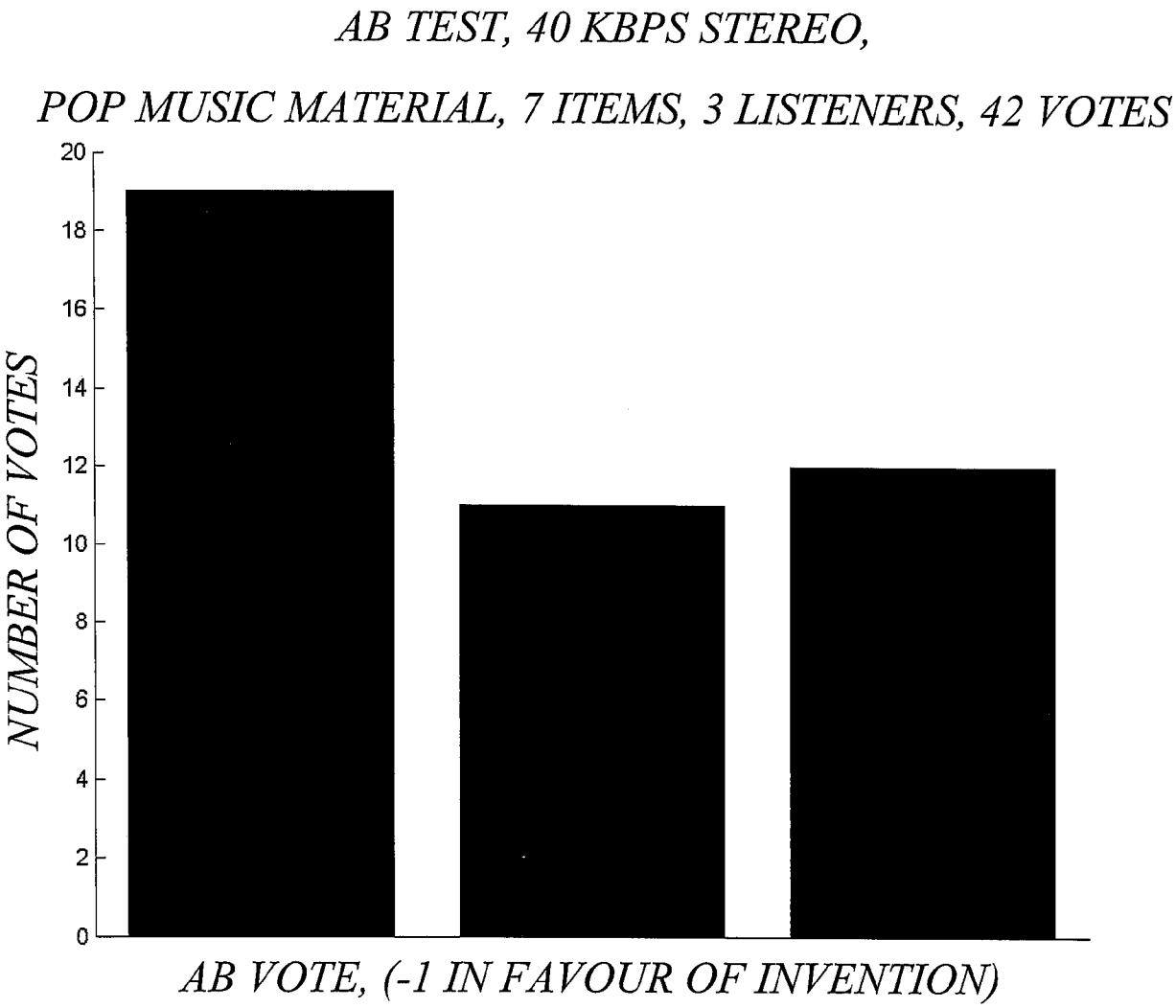
FIG. 12 shows the result from an AB test evaluation of the proposed invention in the form of a histogram of the votes.

As an example, the exemplary method B was tested. The baseline for comparison was using CLD based channel prediction (intensity stereo) in the range 2.2 kHz to 7.0 kHz. The applied method below 2.2 kHz was identical for tested candidates. FIG. 12 shows a histogram of the votes, indicating a preference for the invention.

The audio material consisted of 7 audio clips taken from the AMR-WB+ selection test material.

As already mentioned, the principles of this invention are also applicable to multi-channel scenarios where the input and output channels are more than two.

In the following, an overview of an exemplary multi-channel embodiment operating on p input channels will finally be given.

Figure 13:
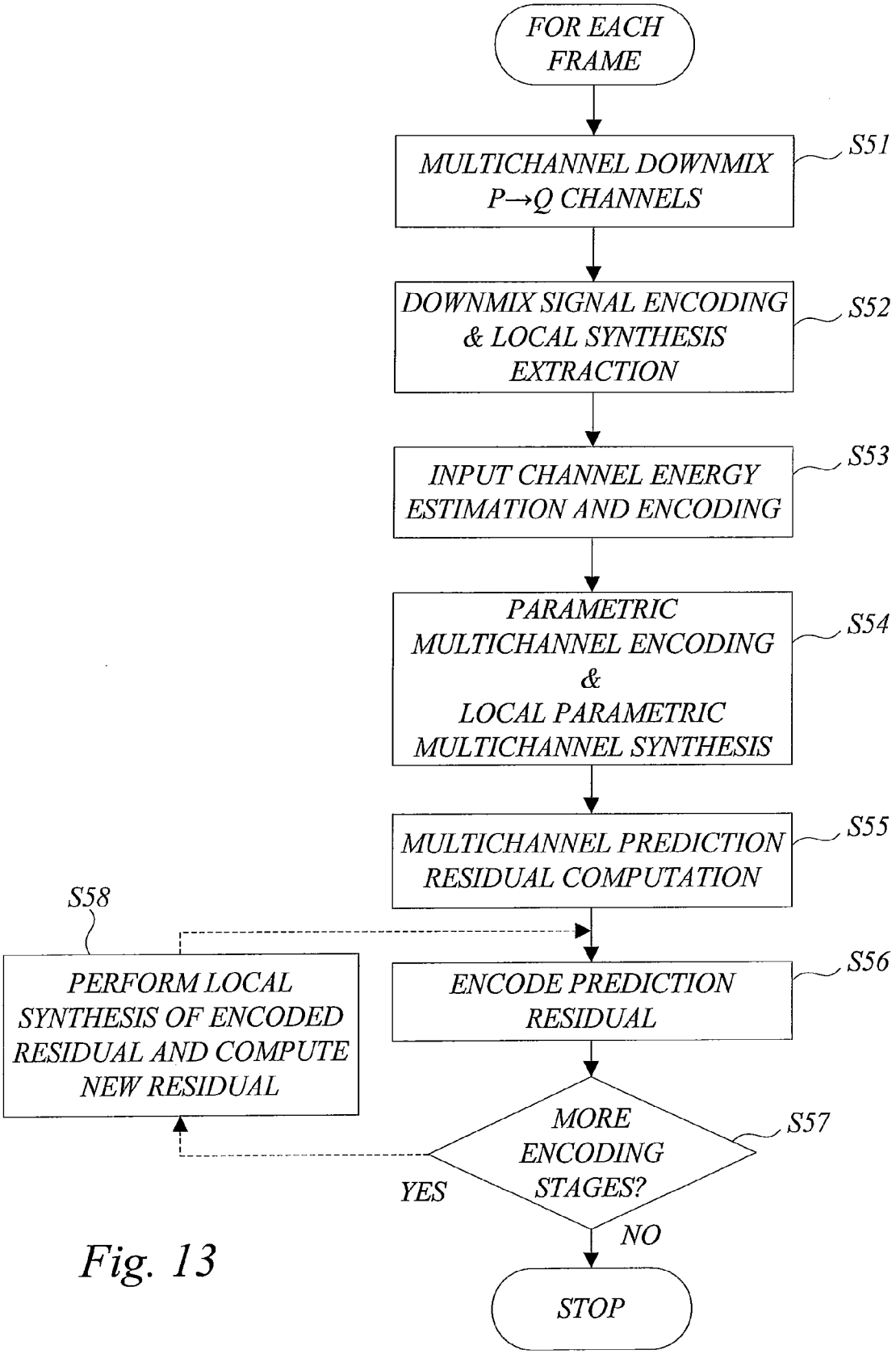
FIG. 13 illustrates an example of the overall encoder operation for a multichannel encoder in the form of a flowchart.

Assume the input signal is a multiple channel signal $\vec{X}=[X_1\ X_2\ \ldots\ X_p]$ with p channels. The encoder creates a down-mix signal $\vec{Y}=[Y_1\ Y_2\ \ldots\ Y_q]$ with q channels, where p>q. The properties of the down-mix may create dependencies between the channels of the original multichannel signal and the down-mixed signal which can be exploited to make efficient representations of the channel energies and channel predictors. The multichannel down-mix as such can be performed in multiple stages as have been seen in prior art [5]. If pair-wise channel combinations are performed, principles from the stereo embodiments may apply. The down-mixed signal is fed to a first stage encoder which operates on q channels, and a locally decoded down-mix signal $\hat{\vec{Y}}$ is extracted from this process. This signal is used in a multichannel prediction or upmix step, which creates a first approximation $\hat{\vec{X}}$ to the input multichannel signal. The approximation is subtracted from the original input signal, forming a multichannel prediction residual or parametric residual. The residual is fed to a second encoding stage. If desired, a locally decoded residual signal can be extracted and subtracted from the original residual signal to create a second stage residual signal. This encoding process can be repeated to provide further refinements converging towards the original input signal, or to capture different properties of the signal. The encoded prediction, energy and residual parameters are transmitted or stored to be used in a decoder. An overview of an example of the encoding process can be seen in FIG. 13.

Figure 14:
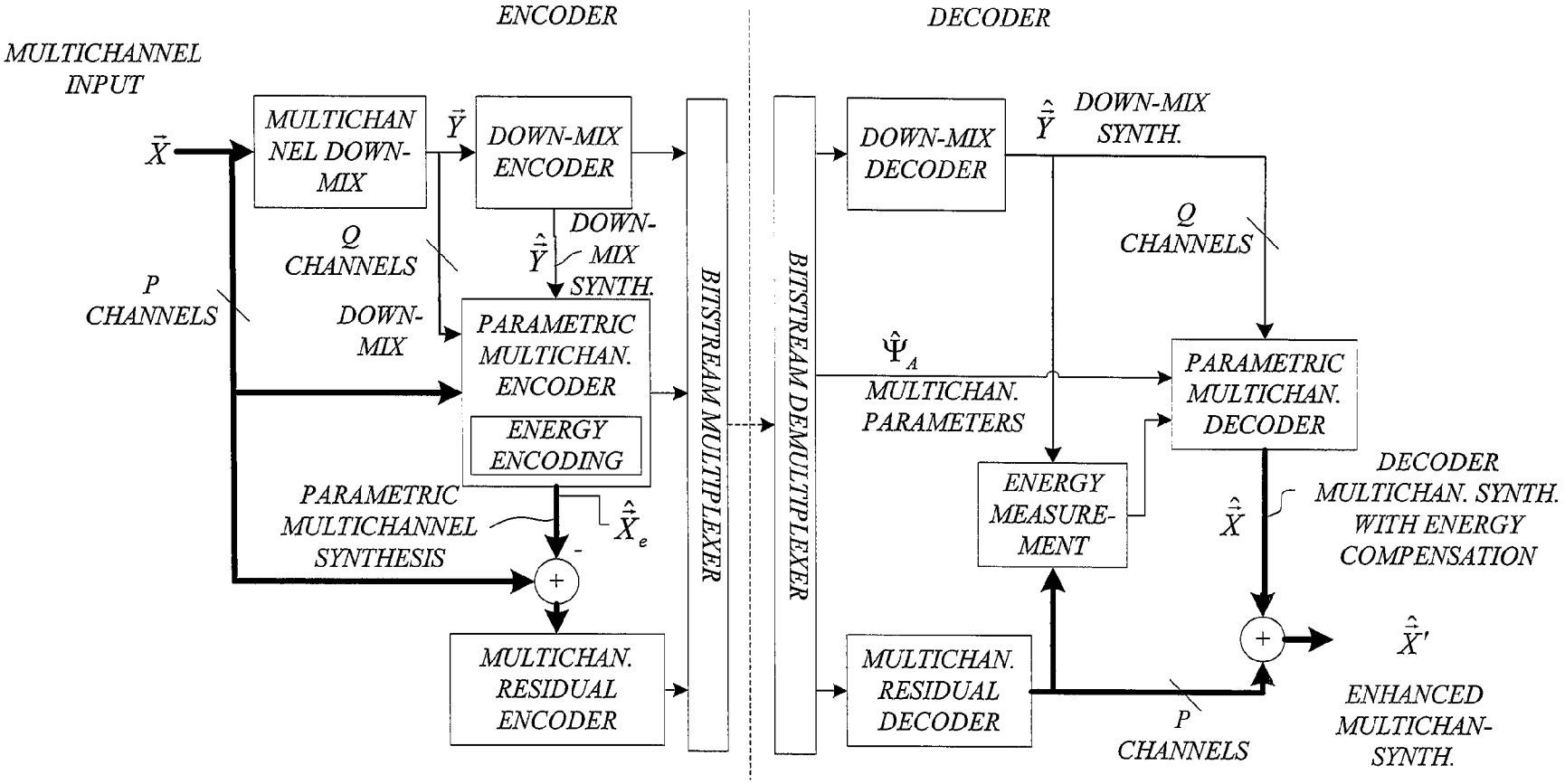
FIG. 14 shows a possible multichannel embodiment of the encoder and decoder processes, where the energy measurement on received signals is performed before the multichannel prediction.
Figure 15:
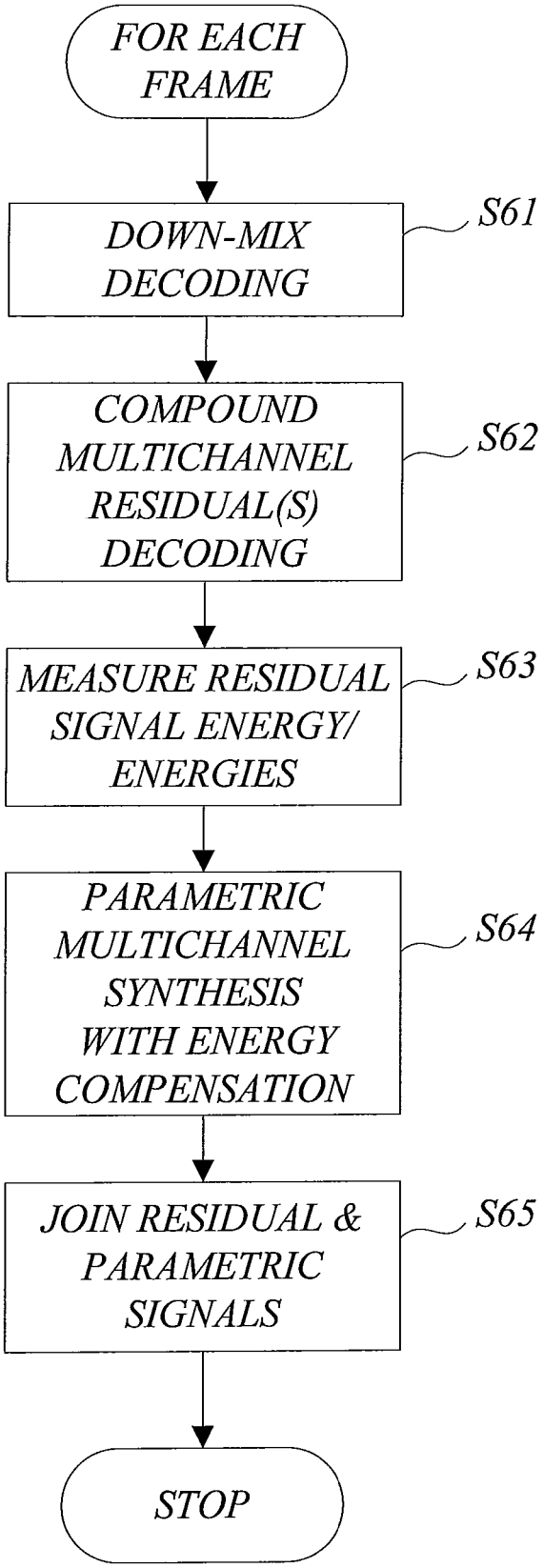
FIG. 15 is a flowchart which illustrates an example of the overall decoder operation when the energies of the decoded signal components are estimated before the multichannel prediction.
Figure 16:
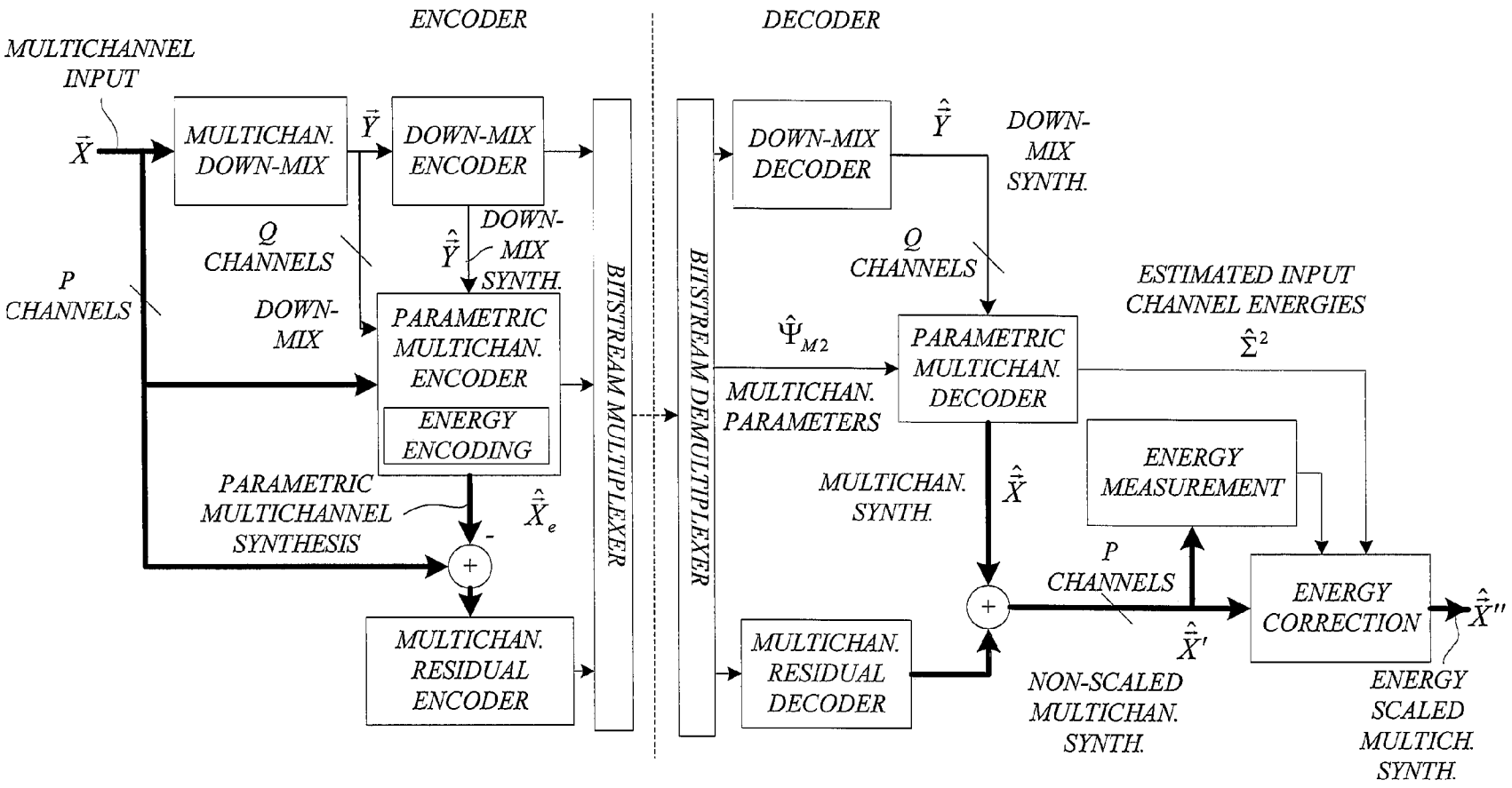
FIG. 16 shows a possible multichannel embodiment of the encoder and decoder processes, where the energy measurement of received signals are performed after the multichannel prediction.
Figure 17:
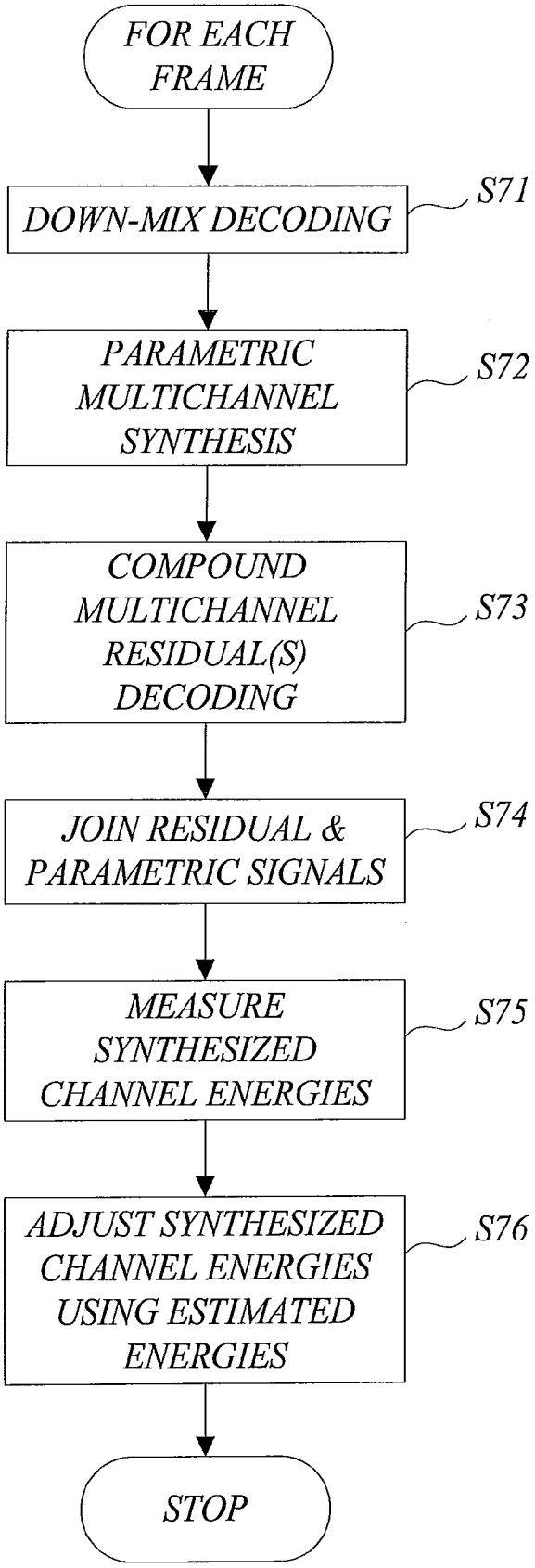
FIG. 17 is a flowchart which illustrates an example of the overall decoder operation when the energies of the decoded signal components are estimated after the multichannel prediction.

In an exemplary embodiment, the overall decoder performs a decoding of the down-mixed signal corresponding to the locally decoded down-mixed signal in the encoder. The encoded residual or residuals are decoded. Using the transmitted prediction and energy parameters, a first stage multichannel prediction or upmix is performed. The multichannel prediction may be different from the multichannel prediction in the encoder. The decoder measures the energies of the received and decoded signals, such as the decoded down-mixed signal, the predicted multichannel signal and residual signal or signals. An energy estimate of the input channel energies is calculated and is used to combine the decoded signal components into a multichannel output signal. The energies may be measured before the prediction stage, allowing the output energy to be controlled jointly with the prediction as illustrated in FIG. 14 and FIG. 15. The energies may also be measured after the signal components have been joined and adjusted in a final stage on the joined components as illustrated in FIG. 16 and FIG. 17.

The embodiments described above are merely given as examples, and it should be understood that the present invention is not limited thereto. Further modifications, changes and improvements which retain the basic underlying principles disclosed and claimed herein are within the scope of the invention.

ABBREVIATIONS

AAC Advanced Audio Coding
AAC-BSAC Advanced Audio Coding—Bit-Sliced Arithmetic Coding
AMR Adaptive Multi-Rate
AMR-WB Adaptive Multi-Rate Wide Band
AOT Audio Object Type
BCC Binaural cue coding [2]
BMLD Binaural masking level difference
CELP Code Excited Linear Prediction
CfI Call for Information
CLD Channel level difference
CLS Channel level sum
EV Embedded VBR (Variable Bit Rate)
ICC Inter-channel correlation
ICP Inter-channel prediction
ITU International Telecommunication Union
LSB Least Significant Bit
MDCT Modified discrete cosine transform MDST Modified discrete sinusoid transform
MMSE Minimum mean squared error
MPEG Moving Picture Experts Group
MPEG-SLS MPEG-Scalable to Lossless
MSB Most Significant Bit
MSE Mean Squared Error
NB Narrow Band (8 kHz samplerate)
SNR Signal-to-noise ratio
SWB Super Wide Band (32 kHz samplerate)
PS Parametric Stereo
VMR-WB Variable Multi Rate-Wide Band
VoIP Voice over Internet Protocol
WB Wide Band (16 kHz samplerate)
xDSL x Digital Subscriber Line

REFERENCES

[1] ISO/IEC JTC 1, SC 29, WG 11/M11657, "Performance and functionality of existing MPEG-4 technology in the context of Cfl on Scalable Speech and Audio Coding", January 2005.

[2] C. Faller and F. Baumgarte, "Binaural cue coding—Part I: Psychoacoustic fundamentals and design principles", *IEEE Trans. Speech Audio Processing*, vol. 11, pp. 509-519, November 2003.

[3] Samsudin et al, "A stereo to mono downmixing scheme for MPEG-4 parametric stereo encoder", *ICASSP Proceedings*, vol. 5, pp. V-V May 2006.

[4] J. Herre et al, "The Reference Model Architecture for MPEG Spatial Audio Coding", *AES* 118$^{th}$ *Convention,* Paper 6447, May 2005.

[5] ISO/IEC JTC 1, SC 29, WG 11/N7806, "MPEG audio technologies—Part 1: MPEG Surround", pp. 113-114, February 2007.

The invention claimed is:

1. An audio decoding method based on an overall decoding procedure operating on an incoming bit stream for reconstructing a multi-channel audio signal having at least two audio channels, the method comprising:

performing a first decoding process of a first part of the incoming bit stream to produce at least one first decoded channel representation including a decoded down-mix signal;

performing a second decoding process of a second part of the incoming bit stream representative of at least one energy representation of audio input channels to produce at least one second decoded channel representation;

performing residual decoding in a third decoding process of a third part of the incoming bit stream representative of residual error signal information to generate residual error signals;

measuring energies of at least the residual error signals, wherein the second decoding process is further based on the measured energies; and performing channel energy compensation at least partly based on the at least one second decoded channel representation to generate the multi-channel audio signal.

2. The audio decoding method of claim 1 wherein:

measuring the energies comprises measuring the energies of the residual error signals and the decoded down-mix signal; and performing the second decoding process comprises performing the second decoding process to produce the at least one second decoded channel representation based on the second part of the incoming bit stream, the decoded down-mix signal, and the measured energies.

3. The audio decoding method of claim 2 further comprising controlling the second decoding process such that the channel energy compensation is performed upon a combination of the at least one second decoded channel representation with the residual error signals.

4. The audio decoding method of claim 1 further comprising combining the residual error signals with the at least one second decoded channel representation to generate at least one combined multi-channel synthesis, wherein measuring the energies comprises measuring the energies based on the at least one combined multi-channel synthesis.

5. The audio decoding method of claim 4 further comprising determining an energy correction factor based on the measured energies and the at least one combined multi-channel synthesis, wherein performing the channel energy compensation comprises applying the energy correction factor to the at least one combined multi-channel synthesis to generate the multi-channel audio signal.

6. The audio decoding method of claim 1, wherein performing the channel energy compensation comprises performing the channel energy compensation to match the energies of output channels of said multi-channel audio signal with estimated input channel energies.

7. The audio decoding method of claim 6, wherein the output channels of said multi-channel audio signal are matched with corresponding input channels at an encoding side both in terms of energy and quality, and wherein higher quality signals are represented with a larger proportion than lower quality signals to improve the overall quality of the output channels.

8. The audio decoding method of claim 1, wherein performing the channel energy compensation comprises integrating the channel energy compensation into the second decoding process when producing at least one second decoded channel representation.

9. The audio decoding method of claim 1, wherein performing the second decoding process comprises synthesizing predicted channels to produce the at least one second decoded channel representation, and wherein performing the residual decoding comprises generating residual prediction error signals.

10. The audio decoding method of claim 9, wherein performing the second decoding process comprises:

deriving the at least one energy representation of the audio input channels from the second part of the incoming bit stream;

estimating channel prediction parameters at least partly based on the at least one energy representation; and synthesizing the predicted channels based on the decoded down-mix signal and the estimated channel prediction parameters to produce the at least one second decoded channel representation.

11. The audio decoding method of claim 10, wherein deriving the at least one energy representation comprises deriving channel energy level differences and delta energy measures from the second part of the incoming bit stream, the method further comprising estimating input channel energies based on estimated energy of the decoded down-mix signal and the derived channel energy level differences and delta energy measures, wherein estimating the channel prediction parameters comprises estimating the channel prediction parameters based on the estimated input channel energies, the estimated energy of the decoded down-mix signal, and the measured energies.

12. An audio decoder device configured to operate on an incoming bit stream for reconstructing a multi-channel audio signal having at least two channels, the audio decoder device comprising:

a first circuit comprising a first decoder configured to perform a first decoding process of a first part of the incoming bit stream to produce at least one first decoded channel representation including a decoded down-mix signal;

a second circuit comprising a second decoder configured to perform a second decoding process of a second part of the incoming bit stream representative of at least one energy representation of audio input channels to produce at least one second decoded channel representation;

a residual circuit comprising a residual decoder configured to generate residual error signals from a third part of the incoming bit stream representative of residual error signal information; and an energy measurement circuit configured to measure energies of at least the residual error signals, wherein the second circuit is further configured to produce the at least one second decoded channel representation based on the measured energies;

wherein the audio decoder device is configured to perform channel energy compensation at least partly based on the at least one second decoded channel representation to generate the multi-channel audio signal.

13. The audio decoder device of claim 12 wherein:

the energy measurement circuit is configured to measure the energies of the residual error signals and the decoded down-mix signal; and audio decoder device performs the second decoding process by performing the second decoding process to produce the at least one second decoded channel representation based on the second part of the incoming bit stream, the decoded down-mix signal, and the measured energies.

14. The audio decoder device of claim 13 further comprising a combiner, wherein the second decoder is controlled such that the channel energy compensation is performed upon a combination of the at least one second decoded channel representation with the residual error signals in the combiner.

15. The audio decoder device of claim 12 further comprising a combiner configured to combine the residual error signals with the at least one second decoded channel representation to generate at least one combined multi-channel synthesis, wherein the energy measurement circuit measures the energies by measuring the energies based on the at least one combined multi-channel synthesis.

16. The audio decoder device of claim 15 wherein the second circuit further comprises an energy correction circuit configured to determine an energy correction factor based on the measured energies and the at least one combined multi-channel synthesis, wherein the audio decoder device performs the channel energy compensation by applying the energy correction factor to the at least one combined multi-channel synthesis to generate the multi-channel audio signal.

17. The audio decoder device of claim 12, wherein the audio decoder device performs the channel energy compensation by performing the channel energy compensation to match the energies of output channels of said multi-channel audio signal with estimated input channel energies.

18. The audio decoder device of claim 17, wherein the output channels of said multi-channel audio signal are matched with corresponding input channels at an encoding side both in terms of energy and quality, and wherein higher quality signals are represented with a larger proportion than lower quality signals to improve the overall quality of the output channels.

19. The audio decoder device of claim 12, wherein the second decoder is configured to synthesize predicted channels to produce the at least one second decoded channel representation, and wherein the residual decoder is further configured to generate residual prediction error signals.

20. The audio decoder device of claim 19, wherein the second decoder synthesizes the predicted channels by:

deriving the at least one energy representation of the audio input channels from the second part of the incoming bit stream;

estimating channel prediction parameters at least partly based on the at least one energy representation; and synthesizing the predicted channels based on the decoded down-mix signal and the estimated channel prediction parameters to produce the at least one second decoded channel representation.

21. The audio decoder device of claim 20, wherein the second decoder derives the at least one energy representation by deriving channel energy level differences and delta energy measures from the second part of the incoming bit stream, wherein the second decoder is further configured to estimate input channel energies based on estimated energy of the decoded down-mix signal and the derived channel energy level differences and delta energy measures, and wherein the second decoder estimates the channel prediction parameters by estimating the channel prediction parameters based on the estimated input channel energies, the estimated energy of the decoded down-mix signal, and the measured energies.

* * * * *